US011148431B2

(12) United States Patent
Yamaguchi et al.

(10) Patent No.: US 11,148,431 B2
(45) Date of Patent: Oct. 19, 2021

(54) IMAGE-RECORDING APPARATUS AND IMAGE-RECORDING METHOD

(71) Applicant: CANON KABUSHIKI KAISHA, Tokyo (JP)

(72) Inventors: Hiromitsu Yamaguchi, Yokohama (JP); Fumitaka Goto, Tokyo (JP); Yuto Kajiwara, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/905,685

(22) Filed: Jun. 18, 2020

(65) Prior Publication Data

US 2020/0406626 A1 Dec. 31, 2020

(30) Foreign Application Priority Data

Jun. 27, 2019 (JP) ..... JP2019-120443

(51) Int. Cl.
*B41J 2/175* (2006.01)
*B41J 11/00* (2006.01)
*B41J 2/21* (2006.01)

(52) U.S. Cl.
CPC ..... *B41J 2/17566* (2013.01); *B41J 11/007* (2013.01); *B41J 2/17563* (2013.01); *B41J 2/21* (2013.01)

(58) Field of Classification Search
CPC ..... B41J 11/0015; B41J 2/01; B41J 11/007; B41J 19/147; B41J 2/17563; B41J 2/17566; B41J 2/21
See application file for complete search history.

(56) References Cited

U.S. PATENT DOCUMENTS 8,529,043 B2 * 9/2013 Kakutani ..... B41J 2/2107 347/100
2011/0227984 A1 * 9/2011 Onishi ..... B41J 11/00214 347/16
2019/0381791 A1 * 12/2019 Goto ..... B41J 2/2114

FOREIGN PATENT DOCUMENTS

JP 61-10483 A 1/1986
JP 7-232473 A 9/1995
JP 8-132731 A 5/1996
JP 9-66664 A 3/1997
JP 9-76628 A 3/1997
JP 2010-52228 A 3/2010

* cited by examiner

*Primary Examiner* — Jannelle M Lebron
(74) *Attorney, Agent, or Firm* — Canon U.S.A., Inc., IP Division

(57) ABSTRACT

Applying a metallic ink, then applying a chromatic color ink with high dye aggregability, and then applying a chromatic color ink with low dye aggregability improve the color development of the chromatic color ink with low dye aggregability.

18 Claims, 18 Drawing Sheets

FIRST PASS SECOND PASS

IMAGE-RECORDING APPARATUS AND IMAGE-RECORDING METHOD

BACKGROUND OF THE INVENTION

Field of the Invention

The present disclosure relates to an image-recording apparatus and an image-recording method for recording a metallic color image on a recording medium.

Description of the Related Art

An image-recording apparatus for recording an image with a metallic luster on a recording medium using a metallic ink containing metal particles has been known in recent years. In another known method, a chromatic color ink containing a coloring material is used in combination with a metallic ink to record a metallic color image.

Japanese Patent Laid-Open No. 2010-52228 discloses a serial ink jet recording apparatus that uses a special glossy ink containing a metal component and a chromatic color ink containing a coloring material to record a metallic color image. Japanese Patent Laid-Open No. 2010-52228 discloses the production of a metallic color with a metallic luster by differentiating the use region of a special glossy ink nozzle array from the use region of a chromatic color ink nozzle array in the sub-scanning direction to make an application time difference between the special glossy ink and the chromatic color ink in a unit region in a recording medium.

SUMMARY OF THE INVENTION

The present disclosure provides a recorded material on which a metallic color desired by a user is produced with a recording apparatus that uses a metallic ink with a function of providing a metallic luster and a chromatic color ink containing a dye as a coloring material.

The present disclosure provides an image-recording apparatus that includes a conveyance unit configured to convey in a conveying direction a recording medium including a receiving layer containing a dye fixative that aggregates a dye; a recording head configured to apply an ink to the recording medium during relative movement in a scanning direction across the conveying direction in a print scan, the recording head including a metallic nozzle array, a first color nozzle array, and a second color nozzle array, the metallic nozzle array including a plurality of nozzles from which a metallic ink containing metal particles is ejected, the first color nozzle array including a plurality of nozzles from which a first chromatic color ink containing a coloring material of the dye is ejected, the second color nozzle array including a plurality of nozzles from which a second chromatic color ink containing a coloring material of the dye is ejected, the second chromatic color ink having lower reactivity with the dye fixative contained in the recording medium than the first chromatic color ink; and a controller configured to control operation of recording an image on the recording medium with the recording head and the conveyance unit based on image data including a metallic color image formed by overlapping the metallic ink, the first chromatic color ink, and the second chromatic color ink, wherein the controller controls the recording operation to perform a first print scan in which only the metallic ink is applied to a region in the recording medium in which the metallic color image is to be formed, after the first print scan, to perform a second print scan in which the first chromatic color ink is applied to the region and in which the metallic ink is not applied to the region, and, after the second print scan, to perform a third print scan in which the second chromatic color ink is applied to the region and in which the metallic ink is not applied to the region.

Further features of the present disclosure will become apparent from the following description of exemplary embodiments with reference to the attached drawings.

DESCRIPTION OF THE EMBODIMENTS

First Embodiment

An embodiment of the present disclosure is described below with reference to the accompanying drawings.

The present embodiment describes an image-recording apparatus for overlapping a metallic ink and a chromatic color ink to record an image including a metallic color portion with a metallic color gloss.

<Description of Image-Recording Apparatus>

Figure 1:
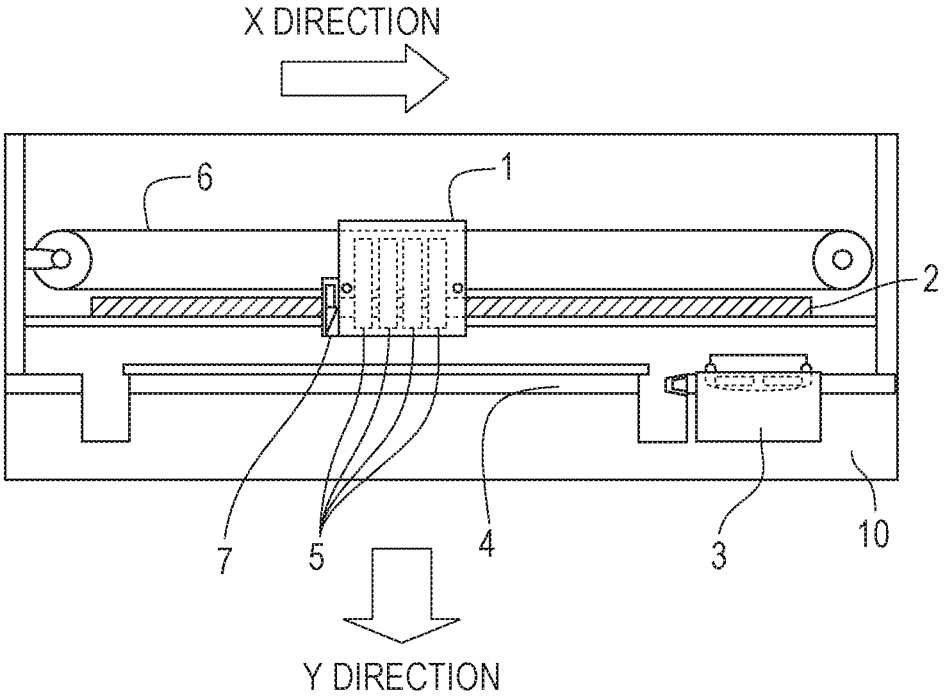
FIG. 1 is an explanatory view of the structure of an ink jet recording apparatus.

FIG. 1 is an explanatory view of the structure of an ink jet recording apparatus 10 (hereinafter also referred to simply as a recording apparatus) applicable to the present embodiment. A carriage 1, on which a recording head 5 with four nozzle arrays and an optical sensor 7 are installed, are reciprocally moved multiple times in the X direction in the figure by the driving force of a carriage motor transferred via a belt 6. While the carriage 1 is moved relative to a recording medium 2, an ink is ejected from the recording head 5 to record an image on the recording medium 2 supported on a platen 4. After the completion of one print scan, the recording medium 2 is conveyed in the Y direction across the X direction in the figure over a distance corresponding to the recording width of one scan. Such a print scan and conveying operation are alternately performed multiple times to record an image on the recording medium 2.

While moving together with the carriage 1, the optical sensor 7 performs detecting operation to detect the recording medium 2 on the platen 4. A recovery unit 3 for maintaining the recording head 5 is located outside the platen 4 in the scanning region in the carriage 1.

<Description of Control Unit>

Figure 2:
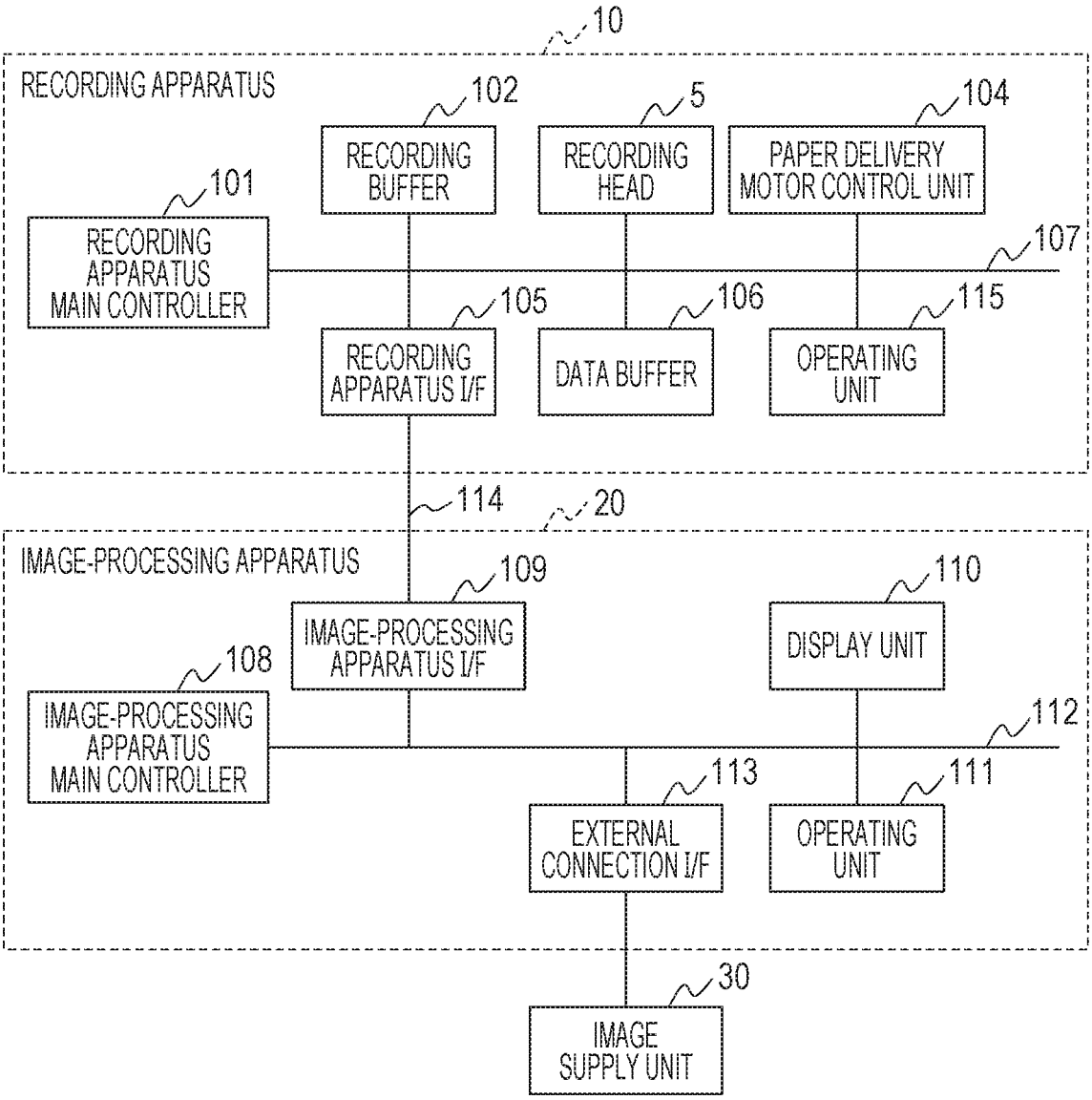
FIG. 2 is a block diagram of a control structure.

FIG. 2 is a block diagram of a control structure of an ink jet recording system according to the present embodiment. The ink jet recording system according to the present embodiment includes an image supply unit 30, the image-processing apparatus 20, and the ink jet recording apparatus 10.

Image data from the image supply unit 30 is subjected to predetermined image processing in the image-processing apparatus 20, is then transmitted to the ink jet recording apparatus 10, and is recorded with an ink. The recording apparatus 10 includes a recording apparatus main controller 101, which includes CPU, ROM, and RAM and controls the ink jet recording apparatus 10. A flow chart described later in FIG. 10 is performed by the CPU of the recording apparatus main controller 101. A recording buffer 102 stores image data as raster data before the image data is transferred to the recording head 5. The recording head 5 is an ink jet recording head with a plurality of recording nozzles from which an ink can be ejected as droplets. Ink droplets are ejected from each recording nozzle according to image data stored in the recording buffer 102. The recording head 5 in the present embodiment has three color nozzle arrays for ejecting three chromatic color inks: a cyan ink containing a cyan coloring material, a magenta ink containing a magenta coloring material, and a yellow ink containing a yellow coloring material. The recording head 5 also has a metallic nozzle array for ejecting a metallic ink containing metal particles. The nozzles of each nozzle array are aligned in the conveying direction of the recording medium.

A paper delivery motor control unit 104 controls the conveyance and delivery of the recording medium. A recording apparatus interface (I/F) 105 transmits data signals to and receives data signals from the image-processing apparatus 20. The I/F signal line 114 couples them. The I/F signal line 114 meets the Centronics specification, for example. A data buffer 106 temporarily stores image data received from the image-processing apparatus 20. A system bus 107 connects the functions of the recording apparatus 10. An operating unit 115 is operated by a user and may be a touch panel or an operating button for receiving instructions, such as power supply on/off of the recording apparatus 10 and an interruption of recording.

An image-processing apparatus main controller 108 mainly controls image data and the formation of an image in the image-processing apparatus 20 and includes CPU, ROM, and RAM. An image-processing apparatus interface (I/F) 109 transmits data signals to and receives data signals from the recording apparatus 10. A display unit 110 gives a user various pieces of information and can display a preview of an image arrangement before printing. An operating unit 111 is operated by a user and may be a keyboard and/or a mouse. A system bus 112 connects the image-processing apparatus main controller 108 to each function. An external connection I/F 113 transmits data signals to and receives data signals from the image supply unit 30.

<Recording Head>

Figure 3:
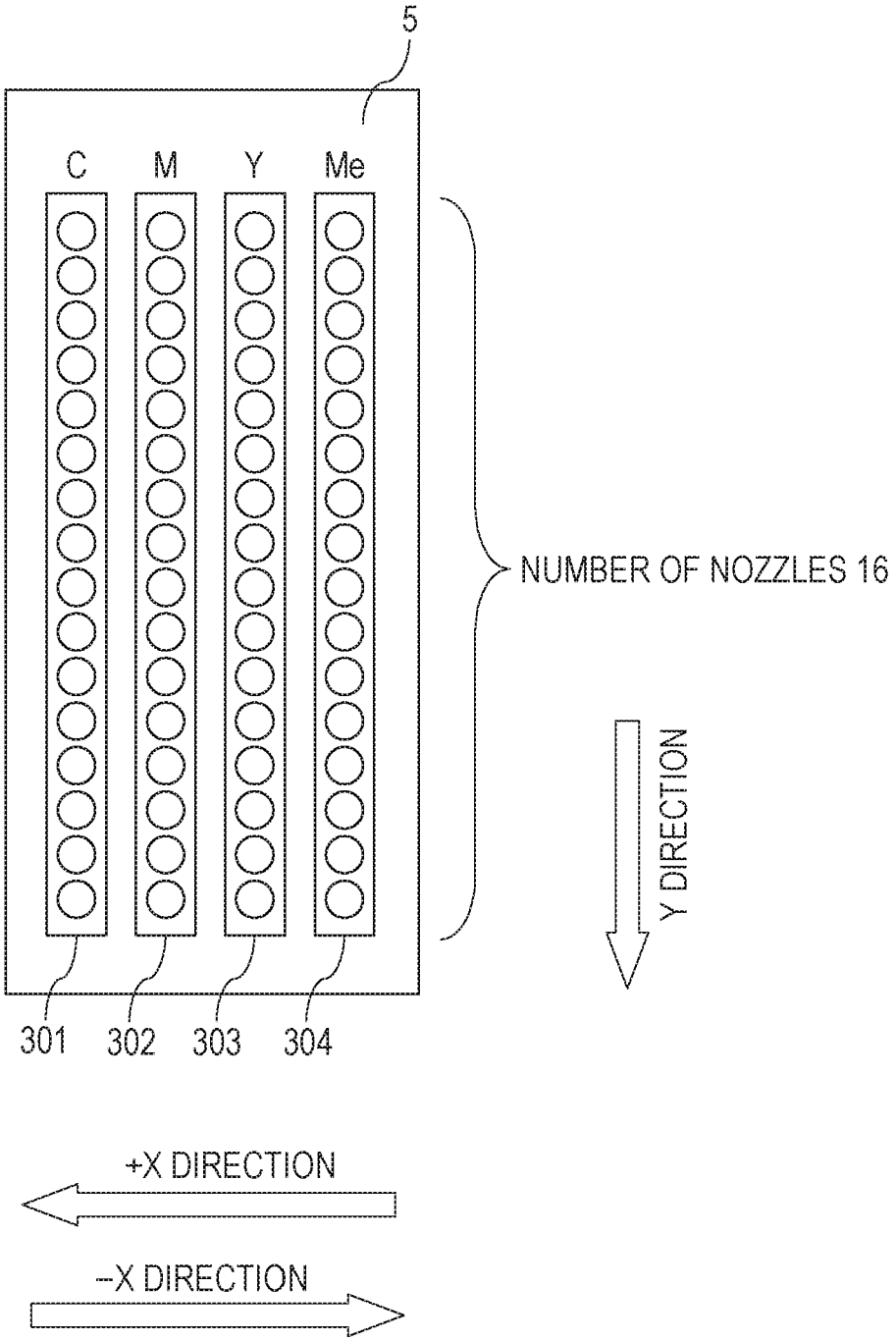
FIG. 3 is an explanatory view of a recording head.

FIG. 3 illustrates the recording head 5 viewed from an ejection port surface. The recording head 5 includes three color nozzle arrays 301, 302, and 303 for ejecting a chromatic color ink and one metallic nozzle array 304 for ejecting a metallic ink arranged in parallel in the X direction. Each of the nozzle arrays 301 to 304 includes ejection ports (nozzles) for ejecting ink droplets aligned in the Y direction at intervals of 1200 dpi. Each ejection port includes a recording element for ejecting ink droplets. For example, 16 nozzles are illustrated in the figure. The color nozzle array 301 is a cyan nozzle array for ejecting cyan (C) ink droplets, the color nozzle array 302 is a magenta nozzle array for ejecting magenta (M) ink droplets, and the color nozzle array 303 is a yellow nozzle array for ejecting yellow (Y) ink droplets. The metallic nozzle array 304 is a nozzle array for ejecting metallic (Me) ink droplets. Although the ejection port arranging direction in the present embodiment is the same Y direction as the conveying direction of the recording medium 2, the ejection port arranging direction may be any direction across the scanning direction of the recording head 5.

<Recording Data>

Figure 4:
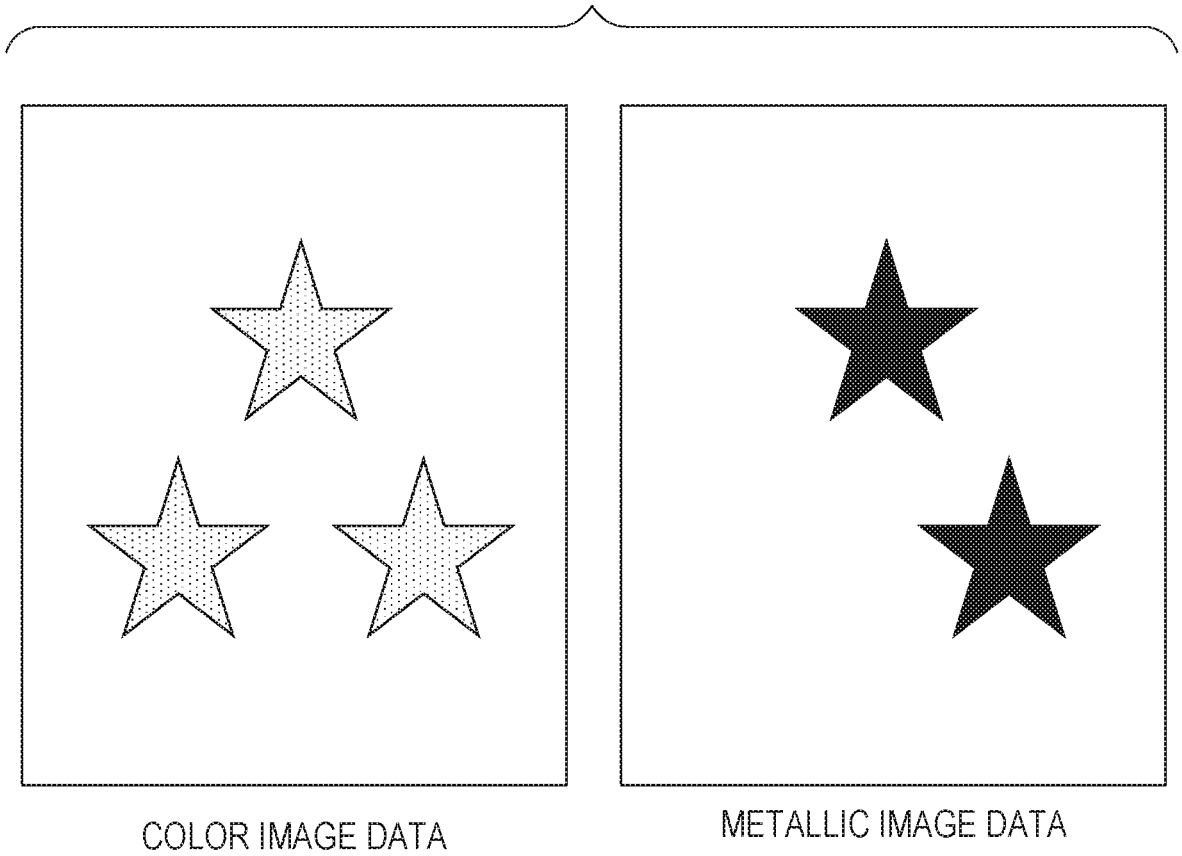
FIG. 4 is an example of a metallic color image data.

FIG. 4 illustrates examples of image data received from the image supply unit 30 by the image-processing apparatus 20. In the present embodiment, two image data were received: color image data for recording with three chromatic color inks per image and metallic image data for recording with a metallic ink. The color image data are red (R), green (G), and blue (B) 8-bit three-dimensional color images for expressing a normalized color space, such as sRGB. The metallic image data is an 8-bit one-dimensional gray image for expressing the gloss of the metallic ink. The image size of the color image data is the same as the image size of the metallic image data. An image region in both image data is expressed as a metallic color portion in recording. In the present embodiment, a plurality of images are chosen for one recording medium in recording, and two image data are received for each image.

<Description of Recording Data Generation Processing>

Figure 5:
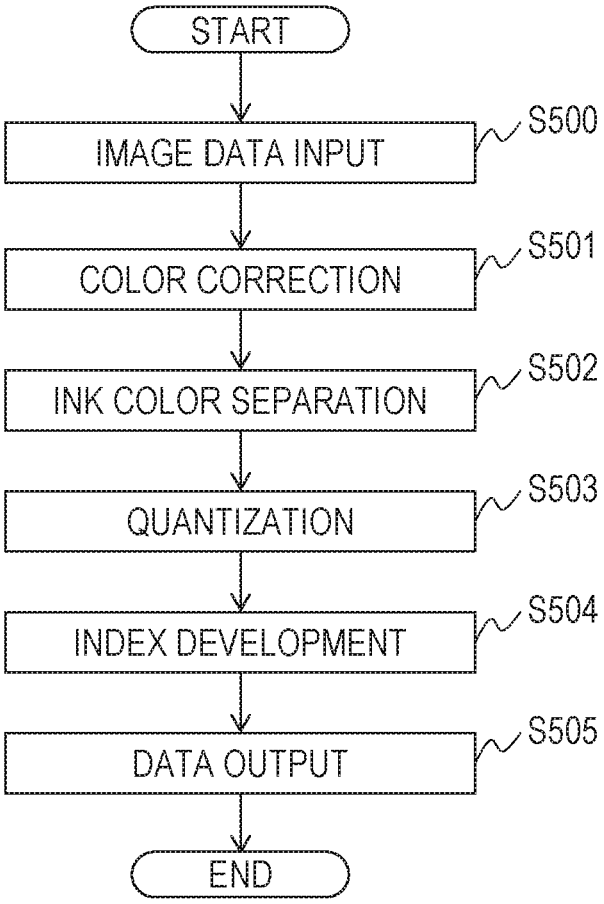
FIG. 5 is an explanatory flow chart of image processing.

FIG. 5 is an explanatory flow chart of image processing in the image-processing apparatus main controller 108. The processing is performed by CPU of the image-processing apparatus main controller 108 according to a program stored in ROM.

First, in the step S500, color image data and metallic image data of pixels of interest are inputted from the image supply unit 30. In the step S501, the image-processing apparatus main controller 108 performs color correction. The color image data is converted to RGB 12-bit luminance data corresponding to the color space characteristic of the recording apparatus. Signal values can be converted by a known method, for example, by referring to a look-up table (LUT) stored in ROM. The metallic image data is an 8-bit one-dimensional gray image and corresponds to the application amount of the metallic ink. Thus, no color correction is performed. In the step S502, the image-processing apparatus main controller 108 separates the converted RGB data into the ink colors of the recording apparatus, cyan (C), magenta (M), and yellow (Y) 16-bit grayscale values (density data). In this step, 16-bit one-dimensional gray images of three channels (three colors) are generated. As in the color correction processing, the ink color separation process is also performed by a known method, for example, by referring to a look-up table (LUT) stored in ROM. The metallic image data is also an 8-bit gray image corresponding to the metallic (Me) ink and is not processed.

In the step S503, the image-processing apparatus main controller 108 converts the grayscale value corresponding to each ink color into several-bit quantization data by predetermined quantization processing. For example, for ternary quantization, the grayscale value is converted to 2-bit data of level 0 to level 2. In the subsequent step S504, the image-processing apparatus main controller 108 performs an index development process. More specifically, one dot arrangement pattern corresponding to the level determined in the step S503 is chosen from a plurality of dot arrangement patterns that define the number and position of dots to be recorded in each pixel. In the dot arrangement pattern, the number of dots to be recorded in a region corresponding to each pixel may depend on the level, or the size of dot may depend on the level. In the step S505, output data subjected to index development in the step S504 is outputted, and the flow is completed.

The process of each step in FIG. 5 may be performed by the image-processing apparatus 20 or the recording apparatus 10 in the ink jet recording system according to the present embodiment. For example, when the image-processing apparatus 20 performs the processes up to quantization processing, quantized data is transferred to the recording apparatus 10, and the recording apparatus main controller 101 performs index development using the index pattern stored in the data buffer 106 and thereby controls the recording operation. Depending on its performance, the recording apparatus 10 can directly receive multivalued color image data and metallic image data and perform all the processes.

<Ink Composition>

The components of the metallic ink containing metal particles in the present embodiment are described below.

<Ink Containing Metal Particles>

<Metal Particles>

The metal particle content (% by mass) of the ink is preferably 0.1% or more by mass and 30.0% or less by mass, more preferably 1.0% or more by mass and 15.0% or less by mass, of the total mass of the ink.

Specific examples of the metal particles include, but are not limited to, gold, silver, copper, platinum, aluminum, titanium, chromium, iron, nickel, zinc, zirconium, and tin particles. These metal particles may be used alone or in combination or may be an alloy thereof. From the perspective of the storage stability of the metal particles and the glossiness of a formed image, the metal particles can be gold, silver, or copper particles, or silver particles. Due to high glossiness and achromaticity of an image formed of silver particles, silver particles in combination with a color ink can produce various metallic colors. As described above, in the present embodiment, a metallic ink containing silver particles is used as an ink containing metal particles.

<Silver Particles>

The silver particles used in the present embodiment are particles composed mainly of silver, and the purity of silver in the silver particles is 50% or more by mass. For example, another metal, oxygen, sulfur, and/or carbon may be contained as an auxiliary component, or an alloy may also be used.

The silver particles may be produced by any method. Considering the particle size control and dispersion stability of the silver particles, the silver particles can be produced by a synthesis method utilizing a reduction reaction of a water-soluble silver salt.

The silver particles used in the present embodiment preferably have an average particle size of 1 nm or more and 200 nm or less, more preferably 10 nm or more and 100 nm or less, in terms of the storage stability of the ink and the glossiness of an image formed of the silver particles.

Specifically, the average particle size can be determined by a method using laser scattering, for example, with FPAR-1000 (manufactured by Otsuka Electronics Co., Ltd., a cumulant analysis) or Nanotrac UPA150EX (manufactured by Nikkiso Co., Ltd., the 50% integrated value of the volume-average particle size).

In the present embodiment, the silver particle content (% by mass) of the ink is preferably 2.0% or more by mass and 15.0% or less by mass of the total mass of the ink. A silver particle content of less than 2.0% by mass may result in an image with a low metallic luster. On the other hand, a silver particle content of more than 15.0% by mass tends to result in ink overflow and a printing position error.

<Dispersant>

The silver particles can be dispersed by any method. For example, the silver particles may be silver particles dispersed with a surfactant or may be resin-dispersed silver particles dispersed with a dispersant resin. As a matter of course, metal particles of different dispersion types can be used in combination.

The surfactant may be anionic, nonionic, cationic, or zwitterionic. More specifically, for example, the following may be used.

The anionic surfactant may be a fatty acid salt, an alkyl sulfate, an alkylaryl sulfonate, an alkyldiaryl ether disulfonate, a dialkyl sulfosuccinate, an alkyl phosphate, a naphthalene sulfonic acid formalin condensate, a polyoxyethylene alkyl phosphate, or a glycerol borate fatty acid ester.

The nonionic surfactant may be a polyoxyethylene alkyl ether, a polyoxyethylene oxypropylene block copolymer, a sorbitan fatty acid ester, a glycerin fatty acid ester, a polyoxyethylene fatty acid ester, a polyoxyethylene alkylamine, a fluorinated surfactant, or a silicon surfactant. The cationic surfactant may be an alkylamine salt, a quaternary ammonium salt, an alkylpyridinium salt, or an alkylimidazolium salt.

The zwitterionic ionic surfactant may be an alkylamine oxide or phosphatidylcholine.

The dispersant resin may be any water-soluble or water-dispersible resin. In particular, the dispersant resin preferably has a weight-average molecular weight of 1,000 or more and 100,000 or less, more preferably 3,000 or more and 50,000 or less.

More specifically, the dispersant resin may be styrene, vinylnaphthalene, an aliphatic alcohol ester of an $\alpha,\beta$-ethylenically unsaturated carboxylic acid, acrylic acid, maleic acid, itaconic acid, fumaric acid, vinyl acetate, vinylpyrrolidone, acrylamide, or a polymer of a monomer derived from these. At least one monomer of the polymer can be a hydrophilic monomer. A block copolymer, a random copolymer, a graft copolymer, or a salt thereof may also be used. Furthermore, a natural resin, such as rosin, shellac, or starch, may also be used.

In the present embodiment, a dispersant is used to disperse the silver particles in the ink, and the mass ratio of the dispersant content (% by mass) to the silver particle content (% by mass) is preferably 0.02 or more and 3.00 or less.

A mass ratio of less than 0.02 tends to result in abnormal foaming due to unstable dispersion of the silver particles and a consequent high ratio of silver particles deposited on a heating portion of the head or may result in a printing position error due to ink overflow. On the other hand, a mass ratio of more than 3.00 may result in an image with a low metallic luster because the dispersant prevents the fusion of the silver particles during image formation.

<Surfactant>

The ink containing the silver particles used in the present embodiment can contain a surfactant to achieve more balanced ejection stability. The surfactant may be the anionic, nonionic, cationic, or zwitterionic surfactant.

In particular, the nonionic surfactant can be used. The nonionic surfactant can be a polyoxyethylene alkyl ether or an ethylene oxide adduct of acetylenic glycol. These nonionic surfactants have a hydrophile-lipophile balance (HLB) of 10 or more. The amount of surfactants used in combination is preferably 0.1% or more by mass of the ink. The amount of surfactants is preferably 5.0% or less by mass, more preferably 4.0% or less by mass, still more preferably 3.0% or less by mass, of the ink.

<Aqueous Medium>

The ink containing the silver particles used in the present embodiment can contain an aqueous medium containing water and a water-soluble organic solvent. The water-soluble organic solvent content (% by mass) of the ink is preferably 10% or more by mass and 50% or less by mass, more preferably 20% or more by mass and 50% or less by mass, of the total mass of the ink. The water content (% by mass) of the ink is preferably 50% or more by mass and 88% or less by mass of the total mass of the ink.

More specifically, for example, the water-soluble organic solvent may be an alkyl alcohol, such as methanol, ethanol, propanol, propanediol, butanol, butanediol, pentanol, pentanediol, hexanol, or hexanediol; an amide, such as dimethylformamide or dimethylacetamide; a ketone or keto-alcohol, such as acetone or diacetone alcohol; an ether, such as tetrahydrofuran or dioxane; a poly(alkylene glycol) with an average molecular weight of 200, 300, 400, 600, or 1,000, such as poly(ethylene glycol) or poly(propylene glycol); an alkylene glycol with an alkylene group having 2 to 6 carbon atoms, such as ethylene glycol, propylene glycol, butylene glycol, triethylene glycol, 1,2,6-hexanetriol, thiodiglycol, hexylene glycol, or diethylene glycol; a lower alkyl ether acetate, such as polyethylene glycol monomethyl ether acetate; glycerin; or a lower alkyl ether of a polyhydric alcohol, such as ethylene glycol monomethyl(or ethyl) ether, diethylene glycol methyl(or ethyl) ether, or triethylene glycol monomethyl(or ethyl) ether.

The water can be deionized water (ion-exchanged water).

<Other Components>

If necessary, the ink containing the silver particles used in the present embodiment may further contain various additive agents, such as a pH-adjusting agent, an anticorrosive, a preservative, a fungicide, an antioxidant, a reduction inhibitor, an additive resin, and an evaporation promoter.

A metallic color image in the present embodiment includes a coloring layer formed of a coloring material on an achromatic metallic luster layer formed of the silver particles and is formed as a glossy image with a tint resulting from the coloring effect of a chromatic color ink. In this case, light from a light source incident on the coloring layer is reflected from the metallic luster layer, is again transmitted through the coloring layer, and is perceived as a metallic color. Thus, the reflectivity of the metallic luster layer and the chromaticity of the coloring layer are predominant factors of the chromaticity of the metallic color, and therefore transparency as well as the chromaticity are required for the coloring layer. The present embodiment describes below a coloring layer formed of a dye-containing ink containing a dye as a coloring material with high chromaticity and transparency.

<Dye-Containing Ink>

<Dye>

In the present embodiment, a dye-containing ink is applied to a silver layer formed of the ink containing the silver particles on a recording medium. The dye in the dye-containing ink aggregates and remains on the silver layer, thereby forming a metallic color image with a desired color. The use of the dye as a coloring material of the chromatic color ink can form a transparent metallic color image.

A study by the present inventors showed that the coloring effect of the metallic color image depends on the type of dye in the dye-containing ink. More specifically, some dyes tend to remain on the silver layer and have a strong coloring effect on the metallic color image, and other dyes partially permeate the silver layer and have a weak coloring effect on the metallic color image. The present inventors have the following thought about these different types of dyes. Dyes with different structures have different tendencies to aggregate. Dyes that tend to aggregate will associate and form molecular aggregates. For example, in molecular association due to dipole-dipole interaction, an electronic bias (polarization) occurs between atoms of bound molecules with different electronegativities, and the molecules are electrostatically attracted by the polarization. Although we cannot make sweeping statements, compounds with a lone pair, such as a carbonyl group or a heteroaromatic ring, or compounds with a plurality of lone pairs that are conjugated tend to associate. For example, having a nitrogen or sulfur atom with a lone pair, some heteroaromatic rings have a higher electronegativity than the benzene ring and have unbalanced electric charges. When a plurality of lone pairs are conjugated, the lone pairs move via the conjugation and cause polarization.

When an ink containing a dye with high aggregability is applied to the silver layer, the dye aggregates on the silver layer and remains as a coloring layer on the silver layer, thus developing a strong tint in a metallic color image. For example, for a cyan dye with high aggregability, a large amount of cyan dye remains on the coloring layer in a cyan metallic image and develops a strong cyan tint. On the other hand, when an ink containing a dye with low aggregability is applied to the silver layer, the dye, together with the aqueous medium or water in the ink, partially permeates through the pores of the silver layer. Thus, less dye remains in the coloring layer on the silver layer and develops a weak tint in a metallic color image. For example, for a magenta dye with low aggregability, less magenta dye remains in the coloring layer in a magenta metallic image and develops a weak magenta tint. Thus, the magenta metallic image has a color similar to the color of the silver layer.

The aggregability of such a dye can be indicated by a small-angle X-ray scattering method. Two methods are described below.

In a first method, the distance d between particles is calculated from the 2θ of a peak top in a scattering angle profile using the following formula (1) based on the Bragg equation.

$$2d \sin \theta = n\lambda \quad (1)$$

In the formula (1), λ denotes the wavelength of X-rays, d denotes the distance between the particles, and θ denotes the scattering angle.

The calculated d value is the distance between the centers of the particles arranged at regular intervals. The d value determined by this method indicates the size of a molecular aggregate. A larger d value is indicative of a larger molecular aggregate of dye molecules.

A second method determines the peak intensity in the scattering angle profile. The peak shape in the scattering angle profile indicates the dispersion distance distribution of molecular aggregates. Considering that the dispersion distance reflects the size of a molecular aggregate, as described above, such a scattering angle profile indicates the size distribution of molecular aggregates in the solution. If the peak intensity in the scattering angle profile indicates molecular aggregates in the solution, a higher occurrence of molecular aggregates or a higher peak intensity indicates higher aggregability.

To measure the value by small-angle X-ray scattering, the molecule density of the solution must be constant. For example, a 5% by mass aqueous solution with a constant dye concentration is measured by small-angle X-ray scattering. Because the peak intensity depends on the apparatus and measurement conditions, a reference dye may be chosen as a reference of the peak intensity. The reference dye may be C.I. Direct Yellow 132. The C.I. Direct Yellow 132 has insufficient association in the dye-containing ink. A peak intensity sufficiently higher than the peak intensity of the C.I. Direct Yellow 132 indicates high association and aggregability in the dye-containing ink.

As described above, in the present embodiment, a dye cyan ink, a dye magenta ink, and a dye yellow ink are used as chromatic color inks containing a coloring material. The cyan ink has higher aggregability than the yellow ink, and the yellow ink has higher aggregability than the magenta ink. The physical properties other than aggregability, such as viscosity, surface tension, and permeability to paper, of these inks are adjusted to be almost the same.

<Aqueous Medium and Other Components>

The aqueous medium and other components are the same as in the ink containing the silver particles.

The physical properties of the water-based inks, that is, the ink containing the silver particles and the dye-containing ink, are described below.

<Physical Properties of Ink>

The water-based inks according to the present embodiment have a viscosity of 1.0 mPa·s or more and 5.0 mPa·s or less at 25° C. A viscosity of more than 5.0 mPa·s may result in insufficient ink supply to nozzle orifices and unstable ejection in continuous printing. The water-based inks preferably have a viscosity of 3.0 mPa·s or less at 25° C.

The present embodiment properly addresses a disadvantage caused by the following combination. The combination includes accelerated precipitation of silver particles in the use of the silver particles in the above low viscosity region and accelerated evaporation due to heating and accumulated heat near nozzle orifices in a recording apparatus used in the present embodiment.

The water-based inks according to the present embodiment preferably have a static surface tension of 10 mN/m or more and 60 mN/m or less, more preferably 20 mN/m or more and 60 mN/m or less, particularly preferably 30 mN/m or more and 40 mN/m or less, at 25° C. When used in an ink jet system, the inks used in the present embodiment with a surface tension in these ranges can effectively reduce the occurrence of an ejection position error (a deviation of the ink impact point) due to wetting near the ejection ports. The surface tension of the ink can be controlled by appropriately determining the surfactant content of the ink. The inks used in the present embodiment can have a pH suitable for good ejection characteristics in an ink jet recording apparatus.

<Recording Medium>

A recording medium used in the present embodiment includes a substrate and at least one ink-receiving layer and can be a recording medium for an ink jet recording system. The components of the recording medium are described below.

<Substrate>

The substrate may be a base paper or may include a base paper and a resin layer, for example, a base paper covered with a resin. In the present embodiment, the substrate can include a base paper and a resin layer. The resin layer can be located on one or both sides of the base paper.

<Base Paper>

The base paper is composed mainly of wood pulp. If necessary, the base paper is composed of wood pulp and synthetic pulp, such as polypropylene pulp, or synthetic fibers, such as nylon or polyester fibers. The wood pulp may be leaf bleached kraft pulp (LB KP), leaf bleached sulfite pulp (LBSP), needle bleached kraft pulp (NBKP), or needle bleached sulfite pulp (NBSP). The wood pulp may also be leaf dissolving pulp (LDP), needle dissolving pulp (NDP), leaf unbleached kraft pulp (LUKP), or needle unbleached kraft pulp (NUKP). These wood pulps may be used alone or in combination as required. The wood pulp can be LBKP, NBSP, LBSP, NDP, or LDP, which contains a large amount of short fiber component. The pulp can be chemical pulp (sulfate pulp or sulfite pulp) containing less impurities. The base paper may contain a sizing agent, a white pigment, a paper strengthening agent, a fluorescent brightening agent, a water-retaining agent, a dispersant, and/or a softening agent.

<Resin Layer>

When the base paper is covered with a resin, the resin layer covers at least part of the surface of the base paper, and the resin layer coverage (the area of the surface of the base paper covered with the resin layer/the total surface area of the base paper) is preferably 70% or more, more preferably 90% or more, particularly preferably 100%, that is, the surface of the base paper is particularly preferably covered entirely with the resin layer.

The resin layer can be formed of a thermoplastic resin. Examples of the thermoplastic resin include, but are not limited to, acrylic resins, acrylic silicone resins, polyolefin resins, and styrene-butadiene copolymers. Among these, the thermoplastic resin can be a polyolefin resin. The term "polyolefin resin", as used herein, refers to a polymer of an olefin monomer. More specifically, the polyolefin resin may be a homopolymer or a copolymer of ethylene, propylene, and/or isobutylene. The polyolefin resins may be used alone or in combination as required. Among these, the polyolefin resin can be polyethylene. The polyethylene can be a low-density polyethylene (LDPE) or a high-density polyethylene (HDPE).

In the present embodiment, the resin layer may contain a white pigment, a fluorescent brightening agent, and/or an ultramarine blue pigment in order to control its opacity, degree of whiteness, and/or hue. In particular, the resin layer can contain a white pigment to improve its opacity. Examples of the white pigment include, but are not limited to, rutile and anatase titanium oxides. The white pigment content of the resin layer is preferably 25% or less by mass of the resin content. A white pigment content of more than 25% by mass may result in the white pigment with insufficient dispersion stability.

<Ink-Receiving Layer>

In the present embodiment, the ink-receiving layer may be a monolayer or multilayer. The ink-receiving layer may be located on one or both sides of the substrate.

The ink-receiving layer in the present embodiment contains a dye fixative. The materials and dye fixative in the ink-receiving layer are described below.

<Inorganic Particles>

In the present embodiment, the ink-receiving layer can contain inorganic particles. The inorganic particles preferably have an average primary particle size of 50 nm or less, more preferably 1 nm or more and 30 nm or less, particularly preferably 3 nm or more and 10 nm or less. The average primary particle size of inorganic particles is the number-average diameter of circles each having an area equal to the projected area of the corresponding primary particle of the inorganic particles in electron microscope observation. The measurement is performed at 100 or more points.

In the present embodiment, the inorganic particles can be dispersed with a dispersant and can be used in a coating liquid for the ink-receiving layer. The dispersed inorganic particles preferably have an average secondary particle size of 0.1 nm or more and 500 nm or less, more preferably 1.0 nm or more and 300 nm or less, particularly preferably 10 nm or more and 250 nm or less. The average secondary particle size of dispersed inorganic particles can be measured by a dynamic light scattering method.

In the present embodiment, the inorganic particle content (% by mass) of the ink-receiving layer is preferably 50% or more by mass and 98% or less by mass, more preferably 70% or more by mass and 96% or less by mass.

In the present embodiment, the coating weight ($g/m^2$) of the inorganic particles in the formation of the ink-receiving layer can be 8 $g/m^2$ or more and 45 $g/m^2$ or less. This range can result in the ink-receiving layer with a desired film thickness.

Examples of the inorganic particles for use in the present embodiment include, but are not limited to, alumina hydrate, alumina, silica, colloidal silica, titanium dioxide, zeolite, kaolin, talc, hydrotalcite, zinc oxide, zinc hydroxide, aluminum silicate, calcium silicate, magnesium silicate, zirconium oxide, and zirconium hydroxide particles. These inorganic particles may be used alone or in combination as required. Among these inorganic particles, alumina hydrate, alumina, and silica particles can form a porous structure with high ink absorbency.

Alumina hydrate for use in the ink-receiving layer can have the general formula (X): $Al_2O_{3-n}(OH)_{2n}.mH_2O$ (wherein n denotes 0, 1, 2, or 3, and m denotes 0 or more and 10 or less, preferably 0 or more and 5 or less, provided that m or n is not 0). In many instances, $mH_2O$ means a detachable aqueous phase not involved in the formation of a crystal lattice, and therefore m is not necessarily an integer. When the alumina hydrate is heated, m may be 0.

In the present embodiment, the alumina hydrate can be produced by a known method. More specifically, the alumina hydrate can be produced by hydrolyzing an aluminum alkoxide, by hydrolyzing sodium aluminate, or by neutralizing aqueous sodium aluminate with aqueous aluminum sulfate or aqueous aluminum chloride.

It is known that alumina hydrate has a crystal structure of amorphous, gibbsite, or boehmite, depending on the heat treatment temperature. The crystal structure of alumina hydrate can be analyzed by an X-ray diffraction method. In the present embodiment, among these, boehmite or amorphous alumina hydrate can be used. Specific examples include alumina hydrates described in Japanese Patent Laid-Open No. 7-232473, No. 8-132731, No. 9-66664, and No. 9-76628. Commercial products of alumina hydrate include Disperal HP14 and HP18 (manufactured by Sasol). These alumina hydrates may be used alone or in combination as required.

In the present embodiment, the alumina hydrate preferably has a BET specific surface area of 100 $m^2/g$ or more and 200 $m^2/g$ or less, more preferably 125 $m^2/g$ or more and 175 $m^2/g$ or less. The BET specific surface area is determined from the number of molecules or ions with a known size adsorbed on the surface of a sample. In the present embodiment, a gas to be adsorbed on the surface of a sample is nitrogen gas.

Alumina for use in the ink-receiving layer can be fumed alumina. Examples of fumed alumina include, but are not limited to, γ-alumina, α-alumina, δ-alumina, θ-alumina, and χ-alumina. Among these, γ-alumina can provide high image optical density and ink absorbency. Specific examples of fumed alumina include, but are not limited to, Aeroxide Alu C, Alu 130, and Alu 65 (manufactured by Evonik Industries AG.).

In the present embodiment, the fumed alumina preferably has a BET specific surface area of 50 $m^2/g$ or more, more preferably 80 $m^2/g$ or more, and preferably 150 $m^2/g$ or less, more preferably 120 $m^2/g$ or less.

The fumed alumina preferably has an average primary particle size of 5 nm or more, more preferably 11 nm or more, and preferably 30 nm or less, more preferably 15 nm or less. Fumed alumina with an average primary particle size of 5 nm or more can easily retain high ink absorbency. Fumed alumina with an average primary particle size of 30 nm or less allows a silver ink to be fixed to the surface of the ink-receiving layer and tends to result in a high metallic luster.

Alumina hydrate and alumina for use in the present embodiment can be mixed in the form of aqueous dispersion with a coating liquid for the ink-receiving layer using an acid as a dispersant. To reduce blurring of images, the acid dispersant can be a sulfonic acid represented by the general formula (Y): $R—SO_3H$, wherein R denotes a hydrogen atom, an alkyl group having 1 or more and 4 or less carbon atoms, or an alkenyl group having 1 or more and 4 or less carbon atoms. R may be substituted with an oxo group, a halogen atom, an alkoxy group, and/or an acyl group. In the present embodiment, the acid content is preferably 1.0% or more by mass and 2.0% or less by mass, more preferably 1.3% or more by mass and 1.6% or less by mass, of the total alumina hydrate and alumina content.

Silica for use in the ink-receiving layer is broadly divided into wet silica and dry (fumed) silica in accordance with its production method. In one known wet process, a silicate is decomposed with an acid to form activated silica, and the activated silica is subjected to polymerization, coagulation, and sedimentation to produce hydrous silica. In one known dry process (gas-phase process), anhydrous silica is produced by high-temperature gas-phase hydrolysis of a silicon halide (a flame hydrolysis process) or by thermal reduction and vaporization of silica sand and coke using an arc in an electric furnace followed by air oxidization (an arc process). In the present embodiment, silica produced by a dry process (gas-phase process) (hereinafter also referred to as "fumed silica") can be used. Due to its particularly large specific surface area, particularly high ink absorbency, and low refractive index, fumed silica can impart transparency and high color developability to the ink-receiving layer. Specific examples of fumed silica include, but are not limited to, Aerosil (manufactured by Nippon Aerosil Co., Ltd.) and Reolosil QS (manufactured by Tokuyama Corporation).

In the present embodiment, fumed silica preferably has a BET specific surface area of 50 $m^2/g$ or more and 400 $m^2/g$ or less, more preferably 200 $m^2/g$ or more and 350 $m^2/g$ or less.

In the present embodiment, fumed silica can be dispersed with a dispersant and can be used in a coating liquid for the ink-receiving layer. The dispersed fumed silica preferably has a particle size of 50 nm or more and 300 nm or less. The particle size of dispersed fumed silica can be measured by a dynamic light scattering method.

In the present embodiment, alumina hydrate, alumina, and silica may be used in combination. More specifically, at least two selected from alumina hydrate, alumina, and silica powders may be mixed and dispersed to produce a dispersion liquid.

In the present embodiment, the inorganic particles can be alumina hydrate and fumed alumina.

<Binder>

In the present embodiment, the ink-receiving layer can contain a binder. The term "binder", as used herein, refers to a material that can bind inorganic particles together and form a film.

In the present embodiment, the binder content of the ink-receiving layer is preferably 50% or less by mass, more preferably 30% or less by mass, of the inorganic particle content in terms of ink absorbency. The binder content of the ink-receiving layer is preferably 5.0% or more by mass, more preferably 8.0% or more by mass, of the inorganic particle content in terms of the binding of the ink-receiving layer.

Examples of the binder include, but are not limited to, starch derivatives, such as oxidized starch, etherified starch, and phosphorylated starch; cellulose derivatives, such as carboxymethylcellulose and hydroxyethylcellulose; casein, gelatin, soybean protein, poly(vinyl alcohol), and derivatives thereof; latexes of conjugated polymers, such as polyvinylpyrrolidone, maleic anhydride resins, styrene-butadiene copolymers, and methyl methacrylate-butadiene copolymers; latexes of acrylic polymers, such as acrylate and methacrylate polymers; latexes of vinyl polymers, such as ethylene-vinyl acetate copolymers; latexes of functional-group-modified polymers, such as the polymers described above modified with a monomer having a functional group, such as a carboxy group; the polymers described above cationized with a cation group; the polymers described above having a surface cationized with a cation surfactant; the polymers described above having a surface on which poly(vinyl alcohol) is distributed by the polymerization of monomers constituting the polymers in the presence of cationic poly(vinyl alcohol); the polymers described above having a surface on which cationic colloidal particles are distributed by the polymerization of monomers constituting the polymers in a suspension of the cationic colloidal particles; aqueous binders of thermosetting synthetic resins, such as melamine resins and urea resins; polymers and copolymers of acrylates and methacrylates, such as poly (methyl methacrylate); and synthetic resins, such as polyurethane resins, unsaturated polyester resins, vinyl chloride-vinyl acetate copolymers, poly(vinyl butyral), and alkyd resins. These binders may be used alone or in combination as required.

Among these binders, poly(vinyl alcohol) and poly(vinyl alcohol) derivatives can be used. Examples of the poly(vinyl alcohol) derivatives include, but are not limited to, cation-modified poly(vinyl alcohol), anion-modified poly(vinyl alcohol), silanol-modified poly(vinyl alcohol), and poly(vinyl acetal). The cation-modified poly(vinyl alcohol) can be poly(vinyl alcohol) having a primary, secondary, or tertiary amino group or a quaternary ammonium group in its main chain or side chain, as described in Japanese Patent Laid-Open No. 61-10483.

A coating liquid for the ink-receiving layer can be prepared using aqueous poly(vinyl alcohol) or an aqueous poly(vinyl alcohol) derivative. The solid content of the aqueous poly(vinyl alcohol) or the aqueous poly(vinyl alcohol) derivative is preferably 3% or more by mass and 20% or less by mass.

<Cross-Linker>

In the present embodiment, the ink-receiving layer can further contain a cross-linker. Examples of the cross-linker include, but are not limited to, aldehyde compounds, melamine compounds, isocyanate compounds, zirconium compounds, amide compounds, aluminum compounds, boric acids, and borates. These cross-linkers may be used alone or in combination as required. In particular, when the binder is poly(vinyl alcohol) or a poly(vinyl alcohol) derivative, among these cross-linkers, a boric acid or borate can be used.

Examples of boric acids include, but are not limited to, orthoboric acid ($H_3BO_3$), metaboric acid, and hypoboric acid. Borates can be water-soluble salts of these boric acids. Examples of such borates include, but are not limited to, alkali metal salts of boric acids, such as sodium borate and potassium borate, alkaline-earth metal salts of boric acids, such as magnesium borate and calcium borate, and ammonium salts of boric acids. Among these, orthoboric acid can improve the temporal stability of the coating liquid and reduce the occurrence of cracks.

The amount of cross-linker to be used depends on the production conditions. In the present embodiment, the cross-linker content of the ink-receiving layer is preferably 1.0% or more and 50% or less by mass, more preferably 5% or more and 40% or less by mass, of the binder content.

When the binder is poly(vinyl alcohol) and when the cross-linker is at least one selected from boric acids and borates, the total boric acid and borate content can be 5% or more by mass and 30% or less by mass of the poly(vinyl alcohol) content of the ink-receiving layer.

<Dye Fixative>

The ink-receiving layer in the present embodiment contains a dye fixative. The dye fixative in the present embodiment refers to a material that can aggregate a water-based dye-containing ink. Examples of the dye fixative include, but are not limited to, polymers of primary to quaternary amine monomers and derivative monomers thereof, poly (aluminum chloride), and zirconium compounds. Typical examples of the primary to quaternary amines include, but are not limited to, primary amines, such as methylamine, ethylamine, ethylenediamine, and allylamine, secondary amines, such as dimethylamine, diethylamine, diallylamine, dicyandiamide, dimethylenetriamine, and diethylenetriamine, tertiary amines, such as trimethylamine and triethylamine, and quaternary amines, such as diallyldimethylammonium. Polymers of derivative monomers of these primary to quaternary amines may be homopolymers or copolymers of multiple types of monomers. Polymers of derivative monomers of primary to quaternary amines may be of a free type or of a salt type. The salt type may be any salt type, for example, an inorganic acid salt, such as hydrochloride, sulfate, nitrate, sulfite, or phosphate, or an organic acid salt, such as formate, acetate, propionate, methanesulfonate, or p-toluenesulfonate. The salt type may be a complete salt or a partial salt. Typical examples of zirconium compounds include, but are not limited to, zirconium hydrochloride, zirconium sulfate, zirconium nitrate, and zirconium acetate.

These dye fixatives are cationic, react with an anion of a terminal group of a dye, and aggregate the dye, thus having a strong dye fixation effect. These dye fixatives may be used alone or in combination as required. Among these, salt-type polymers of derivative monomers of primary to quaternary amines and poly(aluminum chloride) have a strong dye fixation power.

In the present embodiment, to enhance dye fixation on the silver layer, the power of a dye fixative to aggregate a water-based dye ink (hereinafter referred to as a dye fixation power) is preferably 60% or more, more preferably 80% or more. At a dye fixation power of 60% or more, a dye, together with the dye fixative, tends to aggregate and remain on the silver layer, thus exhibiting a metallic luster of a more vivid color tone.

The dye fixation power can be determined as described below. First, 0.64 mL of a water-based dye-containing ink is added dropwise to 1.36 mL of a dye fixative adjusted to a concentration of 1% to prepare a liquid mixture, and the liquid mixture is stirred. The liquid mixture is then passed through a 0.2 μm filter to remove aggregates and is diluted with water to prepare a 1000-fold diluted liquid mixture. A spectrum of the liquid mixture is measured with a spectrophotometer U-3900/3900H (manufactured by Hitachi, Ltd.). The dye fixation power is represented by the formula (2), wherein Ka denotes the absorbance at a wavelength of 420 nm in a spectrum of a silver ink, and Kb denotes the absorbance at a wavelength of 420 nm in the spectrum of the liquid mixture.

$$\text{Dye fixation power}=(Ka-Kb)/Ka\times 100 \quad (2)$$

Although the dye fixation power in the present embodiment is determined by the above method, the dye fixation power may also be determined as described below. For example, the dye fixation power may be calculated from the rate of change in turbidity measured with a turbidimeter or from the rate of change in haze measured with a haze meter. Any method of calculating the aggregation rate of a water-based dye ink may be used.

In the present embodiment, the dye fixative content of the ink-receiving layer is preferably 0.2 g/m$^2$ or more and 5.0 g/m$^2$ or less, more preferably 0.5 g/m$^2$ or more and 3.0 g/m$^2$ or less. At a dye fixative content of 0.2 g/m$^2$ or more, the dye tends to remain on the silver layer and exhibit a metallic luster of a vivid color tone. A dye fixative content of 5.0 g/m$^2$ or less results in less image degradation in a region with no metallic luster of the silver ink or results in a smaller decrease in ink absorbency. The dye fixative content may be determined by any analytical method that can analyze inorganic and organic substances in the dye fixative. The analytical method may be ICP mass spectrometry, ICP spectroscopy, glow discharge mass spectrometry, atomic absorption spectrometry, ion chromatography, or capillary electrophoresis.

In the present embodiment, the dye fixative content is not particularly limited as long as the dye fixative is contained in the ink-receiving layer. When two or more ink-receiving layers are formed, the dye fixative content of the top ink-receiving layer can be in the above range. After an ink-receiving layer containing no dye fixative is formed, a solution containing a dye fixative may be applied to the ink-receiving layer to form an ink-receiving layer with a dye fixative content in the above range.

<Other Additive Agents>

In the present embodiment, the ink-receiving layer may contain other additive agents. Specific examples of other additive agents include, but are not limited to, a pH-adjuster, a thickener, a flow modifier, an antifoaming agent, a foam inhibitor, a surfactant, a release agent, a penetrant, a color pigment, a color dye, a fluorescent brightening agent, an ultraviolet absorber, an antioxidant, a preservative, a fungicide, a water resistance improver, a dye fixative, a curing agent, and a weatherproofer.

<Undercoat Layer>

In the present embodiment, to improve the adhesion between the substrate and the ink-receiving layer, an undercoat layer may be located between the substrate and the ink-receiving layer. The undercoat layer can contain a water-soluble polyester polymer, gelatin, or poly(vinyl alcohol). The undercoat layer can have a thickness of 0.01 pin or more and 5 μm or less.

<Back Coat Layer>

In the present embodiment, a back coat layer may be located on a surface of the substrate opposite the ink-receiving layer to improve handleability, conveyability, and scratch resistance during conveyance in continuous printing of a plurality of recording media. The back coat layer can contain a white pigment and a binder. The back coat layer preferably has a thickness such that the dry coating amount is 1 g/m$^2$ or more and 25 g/m$^2$ or less.

<Fusion of Silver Ink>

The dot formation state of the metallic ink used in the present embodiment on the recording medium and the formation process of a film of metal particles contained in the metallic ink are described below. As an example of the metallic ink, a silver nanoink containing silver nanoparticles as metal particles dispersed in a solvent (hereinafter also referred to as a "silver ink") is described below.

Figure 6A:
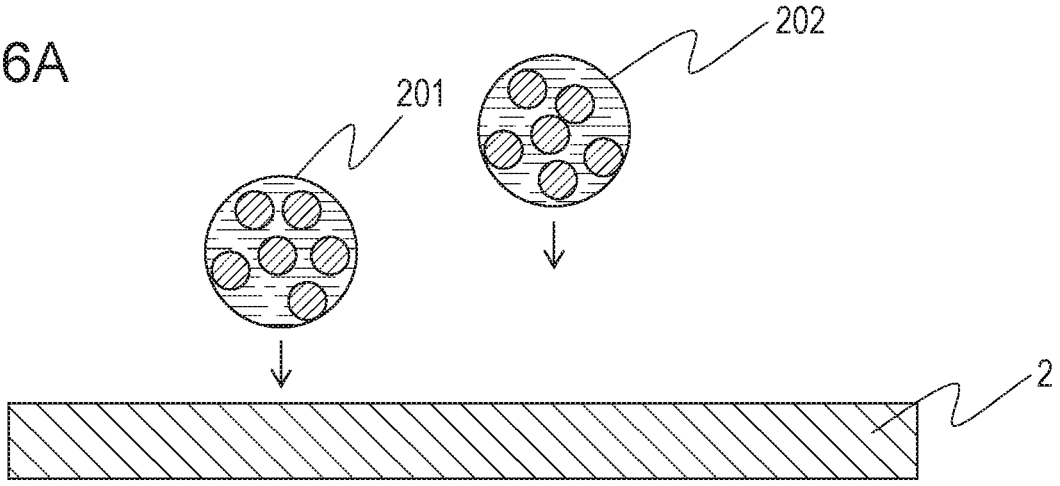
FIGS. 6A to 6D are schematic views of dot formation and film formation of a silver ink.

FIGS. 6A to 6D are schematic views of dot formation and film formation viewed in the cross-sectional direction of the recording medium 2, wherein a plurality of silver ink droplets are applied to the recording medium 2. Application of a second ink droplet after a first ink droplet is described below. FIG. 6A illustrates a first ink droplet 201 immediately before landing on the recording medium 2 and a second ink droplet 202 ejected a certain time after the first ink droplet 201. Each ink droplet contains silver particles 203 and a solvent 204. The silver particles 203 in the ink droplet are silver nanoparticles dispersed in the solvent 204, lose achromatic silver gloss due to local surface plasmon resonance, and assume another color.

Figure 6B:
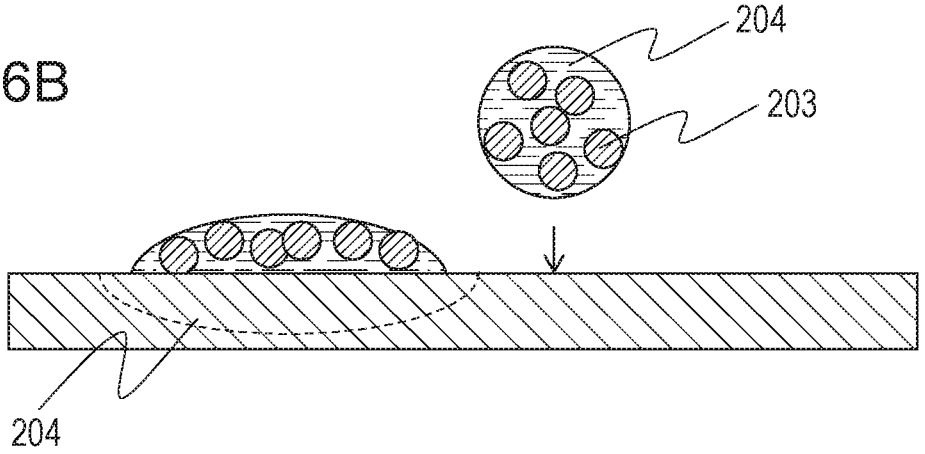
Figure 6C:
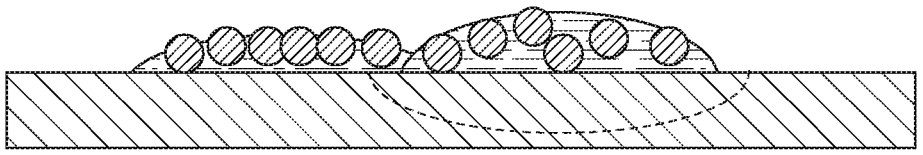
Figure 6D:
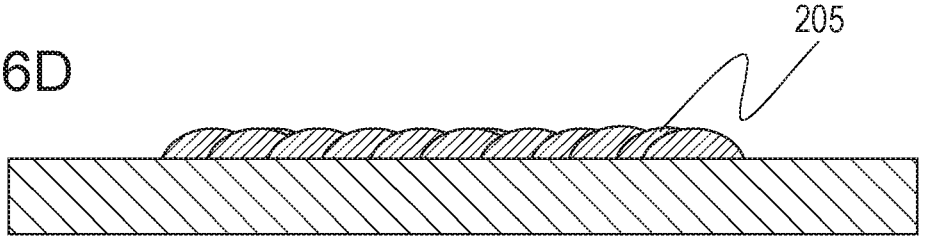

Second, as illustrated in FIG. 6B, the first ink droplet 201 lands on the recording medium 2 before the second ink droplet 202. The solvent 204 in the first ink droplet 201 landing earlier is lost by permeating the recording medium 2 or by evaporating from the ink droplet surface. In step with this, the silver particles 203 come into contact with each other and have increased particle sizes or different shapes. Consequently, as illustrated in FIG. 6C, a silver particle film filled with the silver particles 203 is formed near the surface of the recording medium 2 and develops achromatic silver gloss due to less local surface plasmon resonance. While the silver particle film of the first ink droplet 201 landing earlier is being formed, the second ink droplet 202 lands near the first ink droplet 201. The second ink droplet 202 also forms a silver particle film in the same manner by permeation or evaporation of the solvent 204. As illustrated in FIG. 6D, the ink droplets 201 and 202 come into contact with each other during the formation of the silver particle films, are bound together, and form a silver particle film 205.

<Formation of Metallic Color Image>

A mechanism of the formation of a metallic color image characteristic of the present embodiment is described below. In the present embodiment, a metallic layer of a metallic ink is formed on a recording medium with a receiving layer containing a dye fixative, and a coloring layer of a chromatic color ink is formed on the metallic layer.

First, the metallic ink is applied through the recording head 5 to the recording medium containing the dye fixative. The dye fixative in the receiving layer of the recording medium is redissolved in water of the metallic ink and diffuses into the metallic ink with time. Before the aqueous medium of the metallic ink is evaporated, the dye fixative comes into contact with silver particles in the metallic ink, and a metallic layer containing the dye fixative on the surface or inside is formed.

A dye-containing ink is then applied to the metallic layer. The dye fixative on the surface or inside of the metallic layer is then redissolved in water of the dye-containing ink and enters the dye-containing ink. The dye in the dye-containing ink reacts with the dye fixative on the metallic layer and aggregates. Thus, a coloring layer is formed on the metallic layer.

The coloring layer formed by applying the dye-containing ink to the metallic layer provides a metallic color image with a metallic luster other than silver. To only exhibit a metallic luster other than silver, the coloring layer may be formed in the region in which the metallic layer is formed. To form a metallic image with a silver metallic luster, only the metallic layer may be formed. The coloring layer may exhibit a metallic luster of any color tone and may be formed of an ink composition composed of one dye pigment or two or more dye pigments. A plurality of color inks, such as cyan (C), magenta (M), and yellow (Y), may be mixed. A black (Bk) ink may also be used.

A study by the present inventors, however, showed that a coloring layer formed on the metallic layer by mixing a plurality of inks did not necessarily exhibit a metallic luster of the desired color tone. In a combination of a plurality of inks, a coloring material of one ink may remain in a large amount on the metallic layer, but a coloring material of another ink may permeate the metallic layer, and the tint of the permeated coloring material does not contribute to color development. For example, a study by the present inventors showed that when a dye magenta ink and a dye yellow ink of an ink cartridge BC-341 color (manufactured by CANON KABUSHIKI KAISHA) were combined to exhibit a red metallic luster, the dye magenta ink had less color development. An image formation mechanism in the application of the two inks, the dye magenta ink and the dye yellow ink, in this case is described below with reference to FIGS. 7A to 7E and FIGS. 8A to 8C. Among the CMY dye-containing inks of the ink cartridge BC-341 color (manufactured by CANON KABUSHIKI KAISHA), aggregability is highest in the cyan ink, then in the yellow ink, and lowest in the magenta ink. The order of aggregability of dye in a chromatic color ink is the same as the order of reactivity with a dye fixative. In other words, an ink with relatively high aggregability has high reactivity with a dye fixative, and an ink with relatively low aggregability has low reactivity with a dye fixative.

Figure 7A:
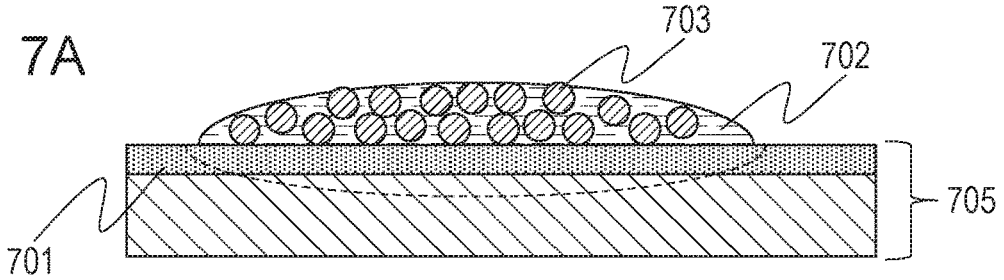
FIGS. 7A to 7E are schematic views of the formation of a metallic layer and a coloring layer.
Figure 7B:
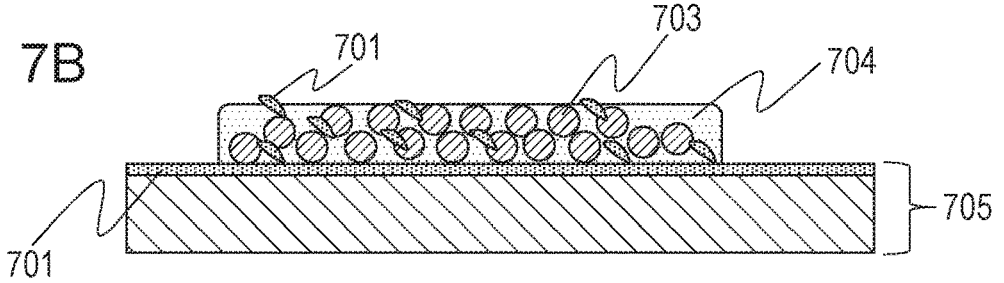
Figure 7C:
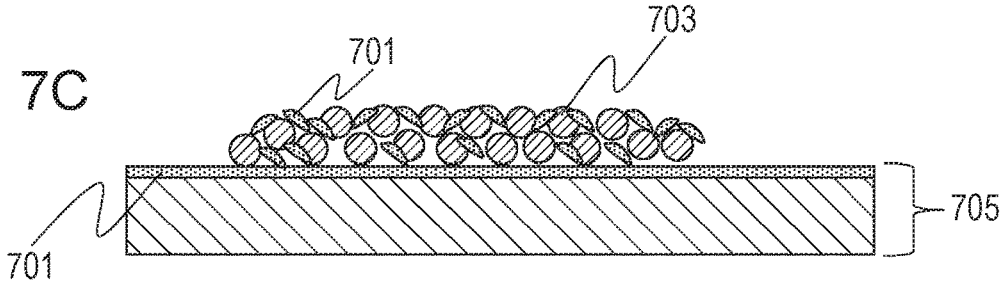

FIGS. 7A to 7E are schematic views illustrating the formation of a metallic layer and a coloring layer when a silver ink and a monochrome water-based ink are applied to a recording medium. FIG. 7A shows that a metallic ink 702 containing silver particles 703 lands on a recording medium 705 with a receiving layer containing a dye fixative 701. FIGS. 7B and 7C illustrate the formation of a metallic layer with the lapse of time after the metallic ink 702 lands in FIG. 7A.

In FIG. 7B, a solvent 704 of the metallic ink 702 remains on the surface layer of the recording medium 705. The dye fixative 701 in the recording medium 705 enters the metallic ink 702 but does not reach the surface layer of the metallic ink layer (silver layer).

In FIG. 7C, the solvent 704 is lost after FIG. 7B and remains little on the surface layer of the recording medium 705. The recording medium 705 absorbs water faster than the solvent 704 from the metallic ink 702. In the figure, water and the solvent 704 pass through voids in the metallic layer and permeate the recording medium 705. A sufficient amount of the dye fixative 701 redissolved in water of the metallic ink 702 reaches the surface layer of the metallic layer.

Figure 7D:
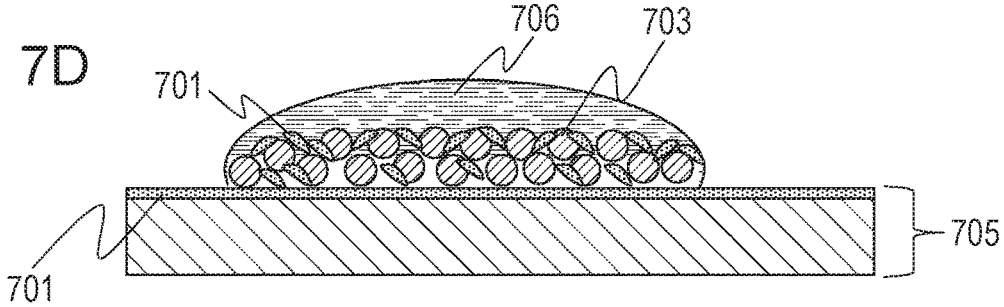

FIG. 7D illustrates a dye-containing ink 706 landing on the metallic layer, wherein the dye fixative 701 reaches the surface layer of the metallic layer. The dye-containing ink 706 is a magenta ink. As described above, even when the magenta ink with low aggregability lands, the dye fixative 701 reaching the surface layer of the metallic layer aggregates a magenta coloring material on the metallic layer.

Figure 7E:
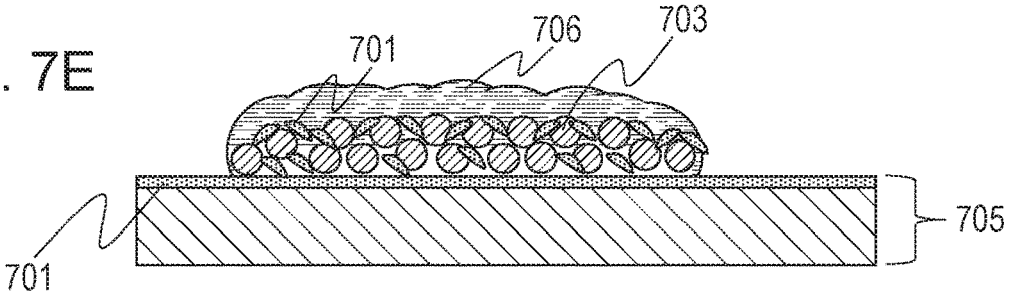

FIG. 7E illustrates a coloring layer of the dye magenta aggregated on the metallic layer. Because the voids in the metallic layer are filled with the solvent 704 of the metallic ink 702, the dye-containing ink 706 slowly permeates the metallic layer. Thus, a metallic color image with a metallic luster of a color tone of the dye magenta can be formed. Likewise, a dye cyan ink or a dye yellow ink can form a coloring layer on the metallic layer and can provide a metallic color image with a metallic luster of a color tone of the dye cyan or dye yellow.

Figure 8A:
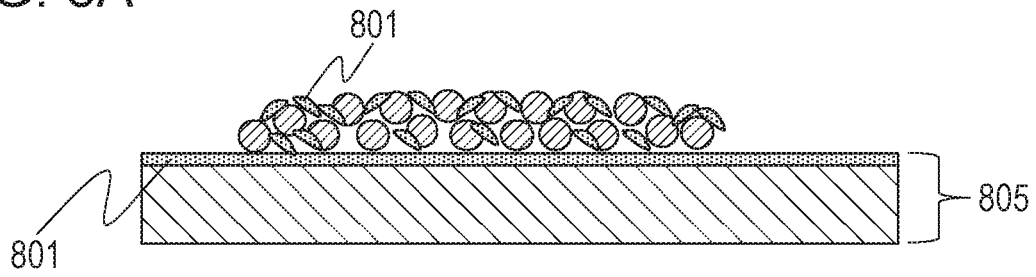
FIGS. 8A to 8C are schematic views of the formation of a metallic layer and a coloring layer.
Figure 8B:
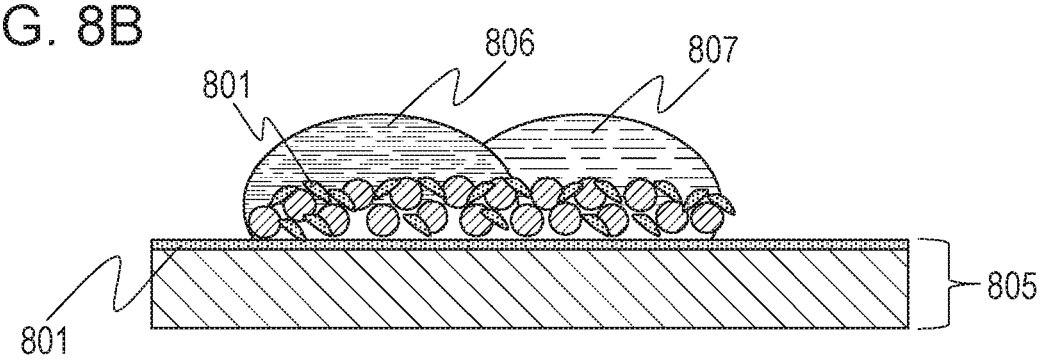
Figure 8C:
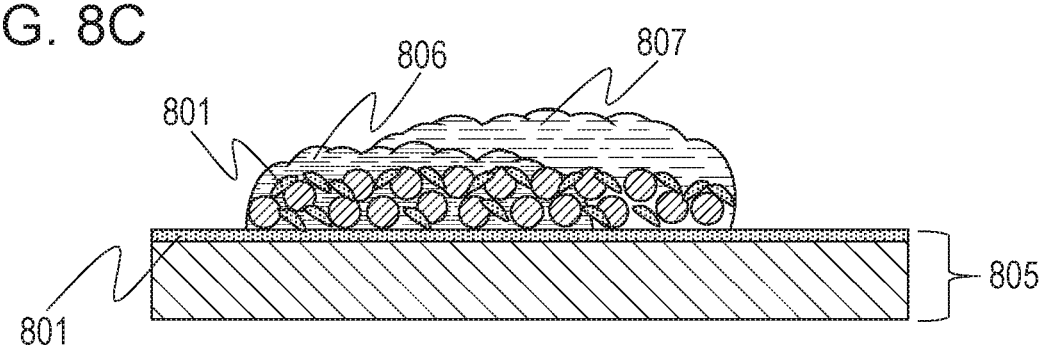

FIGS. 8A to 8C are schematic views illustrating the formation of a metallic layer and a coloring layer when a silver ink and a plurality of dye inks are applied to a recording medium 805. A dye yellow ink with relatively high aggregability and a dye magenta ink with relatively low aggregability are used as dye-containing inks. A gray scale with almost the same amounts of these inks is described below.

Like FIGS. 7A to 7C, FIG. 8A illustrates a metallic layer of a landed metallic ink, wherein a dye fixative 801 reaches the surface layer of the metallic layer.

FIG. 8B illustrates a state immediately after a dye magenta ink 806 and a dye yellow ink 807 are applied to the metallic layer, wherein the surface layer of the metallic layer contains the dye fixative 801. When the yellow ink 807 with relatively high aggregability and the magenta ink 806 with relatively low aggregability are applied to the metallic layer, the dye yellow aggregates relatively early on the metallic layer due to a difference in aggregability between the dye yellow and the dye magenta. A portion of the dye fixative 801 in the surface layer of the metallic layer not used in the aggregation of the dye yellow then aggregates the dye magenta. A portion of the dye magenta not aggregated, together with the aqueous medium and water in the ink, permeates the metallic layer.

FIG. 8C illustrates the dye yellow and dye magenta remaining on the metallic layer. Although the total amount of dyes aggregated on the metallic layer is not changed, among dyes with different aggregation rates, a dye with lower aggregability aggregates in a smaller amount. In the embodiment illustrated in the figure, although the amounts of the yellow ink 807 and the magenta ink 806 are almost the same, the dye yellow with relatively high aggregability remains more than the dye magenta with relatively low aggregability on the metallic layer. Thus, a strong yellowish and visually orangish red metallic color is developed, irrespective of almost the same amounts of the yellow ink 807 and the magenta ink 806.

FIGS. 9A to 9D illustrate the application of a magenta ink with relatively low aggregability after the application of a yellow ink with relatively high aggregability. The application order of these two inks is changed to reduce permeation through the metallic layer. Also in these figures, the application amounts of the yellow ink and the magenta ink are almost the same.

Figure 9A:
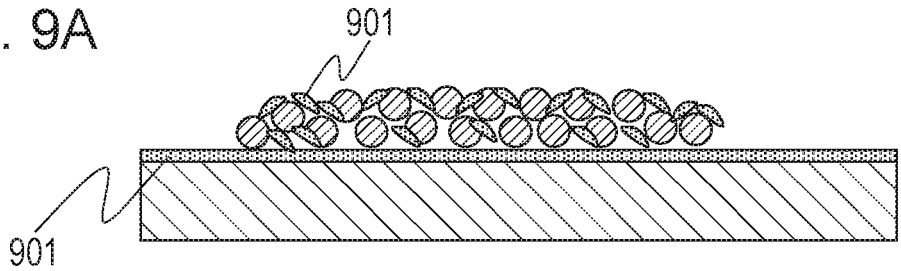
FIGS. 9A to 9D are schematic views of the formation of a metallic layer and a coloring layer.
Figure 9B:
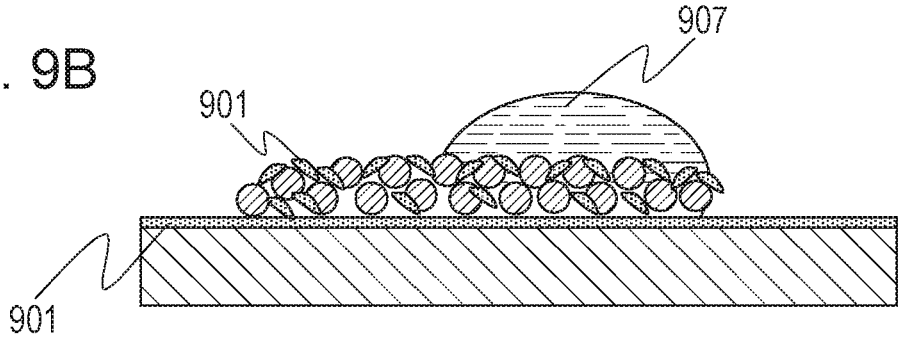

Like FIG. 8A, FIG. 9A illustrates the state after a metallic ink is applied, and a dye fixative 901 is present on the surface layer of the metallic layer. FIG. 9B illustrates the state immediately after a yellow ink 907 is applied to the metallic layer. A dye yellow in the yellow ink 907 begins to aggregate with the dye fixative 901 contained in the metallic layer and begins to be fixed to the metallic layer.

Figure 9C:
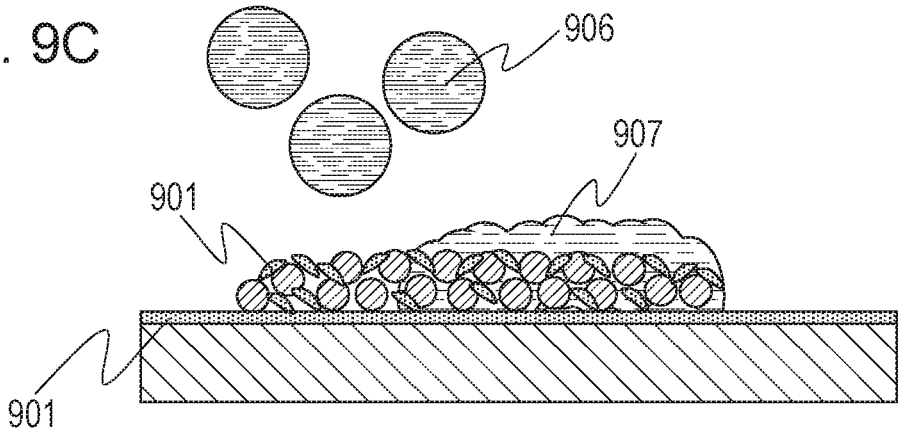
Figure 9D:
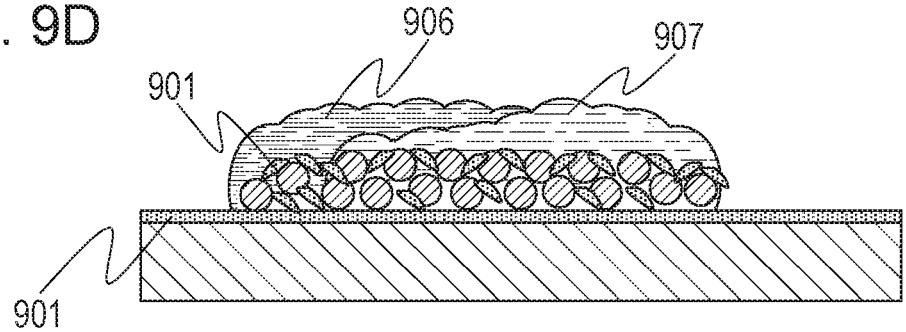
Figure 10A:
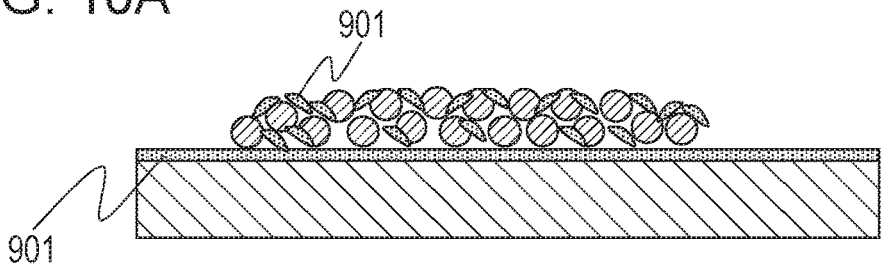
FIGS. 10A to 10D are schematic views of the formation of a metallic layer and a coloring layer.
Figure 10B:
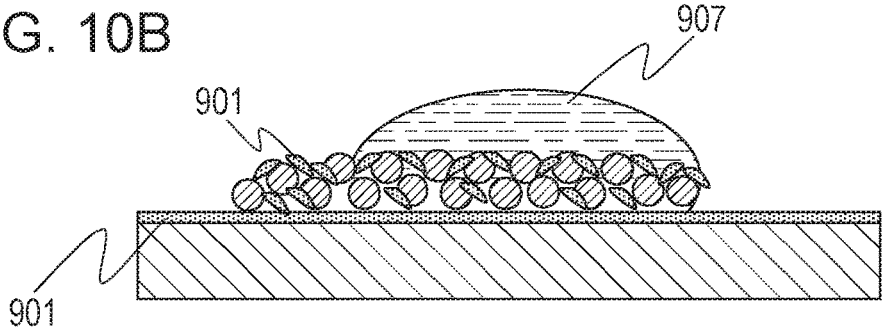
Figure 10C:
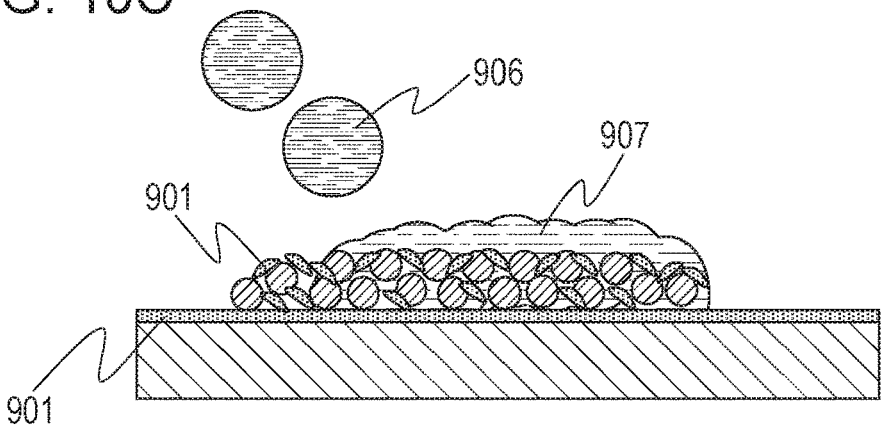
Figure 10D:
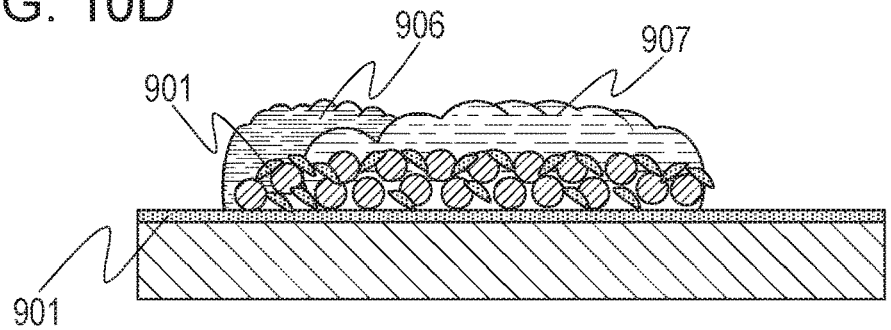
Figure 11A:
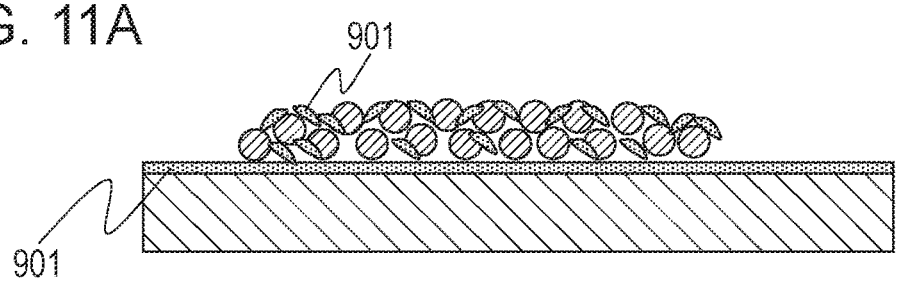
FIGS. 11A to 11D are schematic views of the formation of a metallic layer and a coloring layer.
Figure 11B:
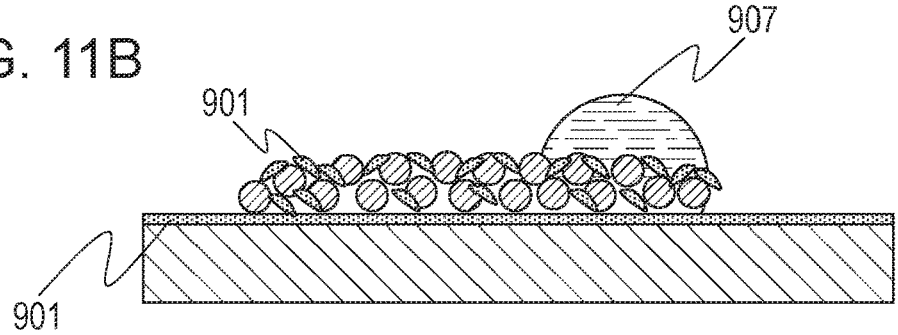
Figure 11C:
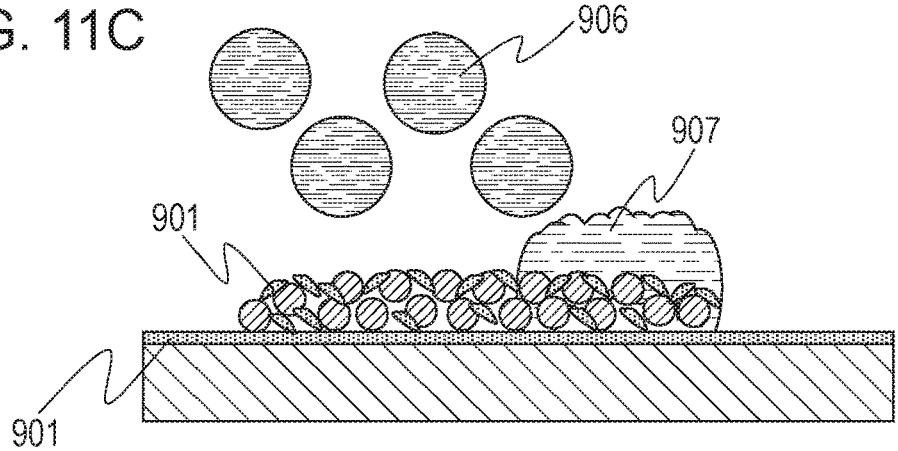
Figure 11D:
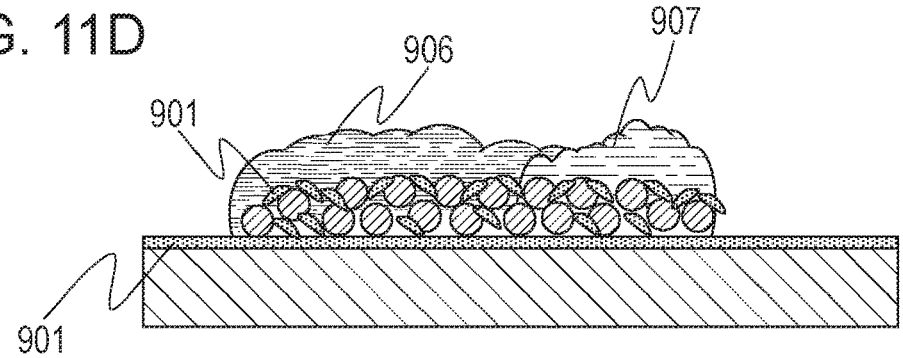

FIG. 9C illustrates the application of a magenta ink 906 while the dye yellow is aggregating on and is being fixed to the surface layer of the metallic layer. Although the dye yellow is aggregating on and is mostly fixed to the surface layer of the metallic layer, the dye yellow is partly redissolved in the magenta ink 906 applied later. In the redissolved portion, a portion of the dye fixative 901 reacts with and again aggregates the dye yellow and/or the dye magenta. Due to the difference in aggregability of the two inks as described above, the dye yellow reaggregates more than the dye magenta, and a portion of the dye magenta not aggregated, together with the solvent and water of the ink, permeates the metallic layer. In a portion of the dye yellow aggregated, fixed, and not redissolved in the magenta ink 906 applied later, it is assumed that the fixed dye yellow fills voids in the metallic layer. It is also assumed that a portion of the solvent of the ink not evaporated also fills voids in the metallic layer. Thus, the aggregated and fixed dye yellow fills the voids in the metallic layer, and the dye magenta applied to the metallic layer is prevented from permeating the metallic layer. Consequently, as illustrated in FIG. 9D, the dye magenta in an amount equal to or greater than the dye yellow remains on the metallic layer.

As described above, to form a metallic color image on a recording medium using a plurality of inks with different aggregabilities, it is effective to control the application timing of each ink according to their respective aggregabilities. To this end, an ink with relatively low aggregability is applied after an ink with relatively high aggregability. This can reduce permeation of a coloring material of the ink with relatively low aggregability and provide a metallic color image with desired color development.

Although a gray scale with almost the same application amounts of yellow ink and magenta ink is described in the above embodiment, the application amounts of yellow ink and magenta ink are not limited to this. Also for a gray scale with a larger application amount of yellow ink or magenta ink, the application timing can be controlled according to the aggregability of the coloring material.

FIG. 10A to 10D illustrate a gray scale with the application amount of yellow ink 907 larger than the application amount of magenta ink 906, wherein the yellow ink 907 is applied after the magenta ink 906. FIG. 10A to 10D illustrate the same state as FIGS. 9A to 9D except that the application amount of yellow ink 907 is larger than the application amount of magenta ink 906 in the present embodiment. The dye yellow applied earlier to the metallic layer aggregates earlier, and fixed dye yellow fills voids in the metallic layer. The dye magenta applied to the metallic layer is prevented from permeating the metallic layer. In the embodiment illustrated in this figure, a larger application amount of the yellow ink 907 enhances the effect of filling voids with the dye yellow and increases the probability of the dye magenta remaining on the surface layer.

FIGS. 11A to 11D illustrate the application of the magenta ink 906 after the yellow ink 907 in the same manner as in FIGS. 9A to 9D, wherein the application amount of the yellow ink 907 is smaller than the application amount of the magenta ink 906. FIGS. 11A to 11D illustrate the same state as FIGS. 9A to 9D except that the application amount of the yellow ink 907 is smaller than the application amount of the magenta ink 906 in the present embodiment. The yellow ink 907 applied earlier to the metallic layer aggregates earlier, and fixed dye yellow fills voids in the metallic layer. The magenta ink 906 is then applied to the metallic layer and partly causes redissolution. The amount of the yellow ink 907 is smaller, and reaggregation of the redissolved portion causes the dye magenta to be left in the surface layer.

A method for controlling the application timing according to the aggregability of ink is more specifically described below.

<Description of Recording Operation>

Figure 12A:
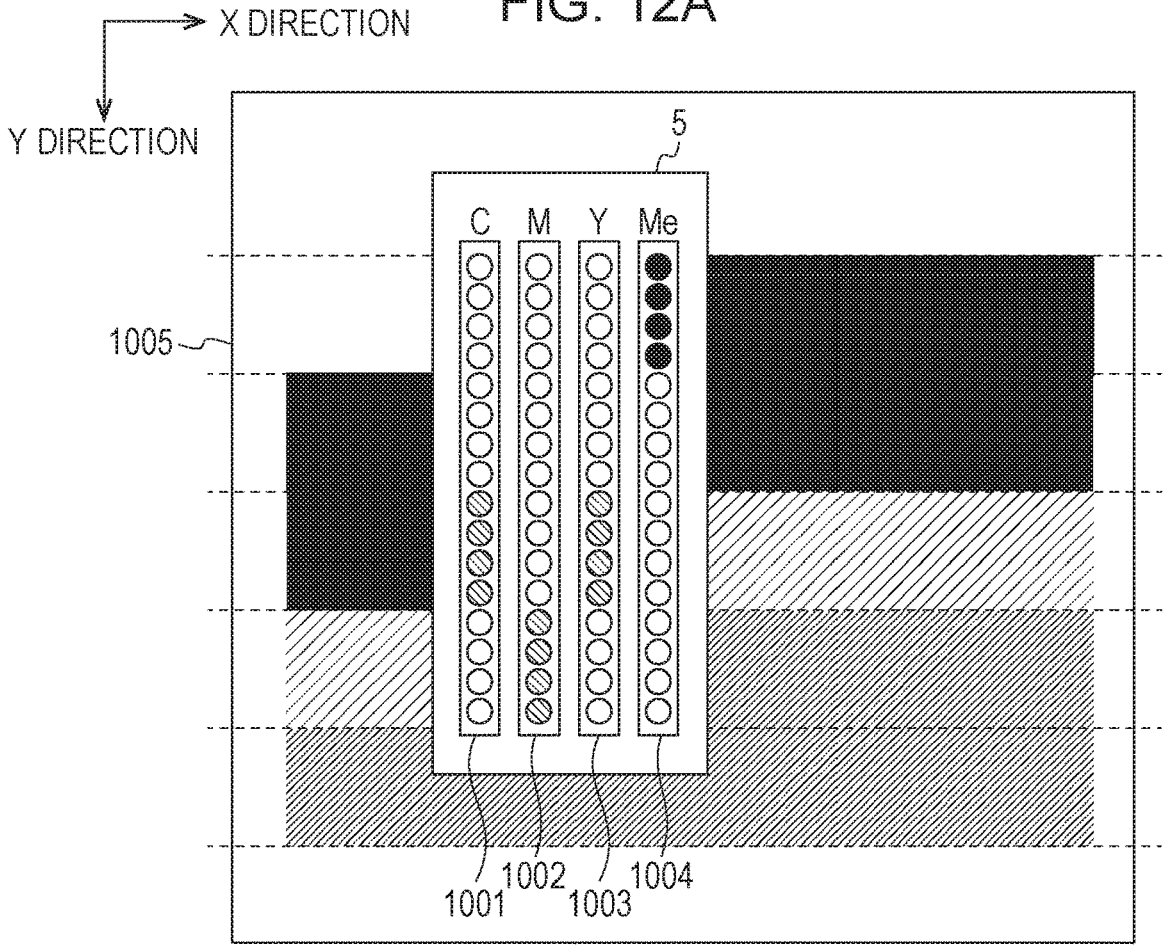
FIGS. 12A and 12B are schematic views of nozzles of a recording head.

FIG. 12A is a schematic view of the arrangement of a nozzle array (recording element array) of the recording head 5 and the nozzles from which ink is actually ejected. As described above, the formation of a metallic color image requires the application of a chromatic color ink after the application of a metallic ink and also requires at least a certain application time difference. In this figure, for convenience of explanation, an image is recorded by a single scan with each color ink.

To record an image, inks are ejected while the recording head 5 is moved in the main scanning direction (in the X direction in the figure). After one print scan, the recording medium is conveyed in the sub-scanning direction (in the Y direction in the figure). An image is formed stepwise on the recording medium by repeatedly performing the print scan with the recording head 5 and conveying the recording medium.

Furthermore, an application time difference is made between the metallic ink and the chromatic color inks. In the figure, a metallic nozzle array 1004 includes metallic ink ejection nozzles arranged in the Y direction. The nozzles from which ink is actually ejected (hereinafter referred to as use nozzles) are front four nozzles 4 colored black. Likewise, in cyan (C), magenta (M), and yellow (Y) chromatic color ink nozzle arrays 1001, 1002, and 1003, the use nozzles from which chromatic color inks are actually ejected are four hatched nozzles. The magenta (M) ink use nozzles are four nozzles located most downstream in the Y direction. The cyan (C) and yellow (Y) use nozzles are four nozzles located upstream of the magenta ink use nozzles in the Y direction and located downstream of the metallic ink use nozzles in the Y direction. The magenta (M) use nozzles do not overlap the cyan (C) and yellow (Y) use nozzles. One conveying operation conveys the recording medium by a length corresponding to four nozzles, thereby enabling the application of the metallic ink before the application of the chromatic color inks. This also enables the application of each chromatic color ink at different time points.

Figure 12B:
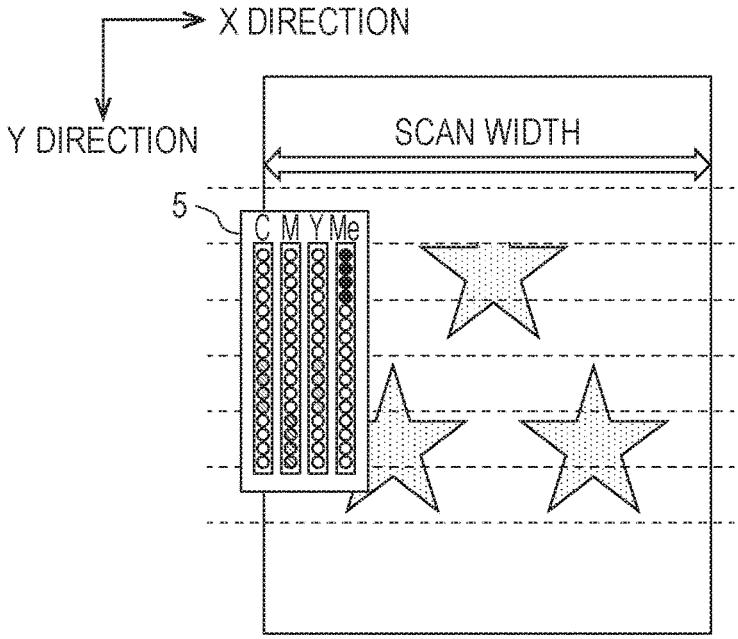

In FIGS. 12A and 12B, the metallic ink is applied to a black region in a recording medium 1005. Likewise, the metallic ink and then the cyan ink and yellow ink are applied to a hatched region in the recording medium 1005. Likewise, the metallic ink, then the cyan ink and yellow ink, and then the magenta ink are applied to a dotted region in the recording medium 1005. The metallic ink use nozzles are located most upstream in the Y direction in the figure, the cyan and yellow ink use nozzles are located second most upstream, and the magenta ink use nozzles are located most downstream in the Y direction. Thus, the metallic ink, the cyan and yellow inks, and the magenta ink are applied at different time points.

In the present embodiment, not only an area where the metallic ink use nozzles are included in does not overlap an area where the chromatic color ink use nozzles are included in, in the Y direction, but also the recording head has a nozzle region through which neither the metallic ink nor the chromatic color inks are ejected. This region is hereinafter referred to as a blank nozzle region. The blank nozzle region through which no ink is ejected can make a sufficient time difference between the application of the metallic ink and the application of the chromatic color inks. In the embodiment illustrated in FIGS. 12A and 12B, two print scans without ink application are performed between the application of the metallic ink and the application of the cyan and yellow inks. Thus, there is a time difference corresponding to two scans between the metallic ink and the chromatic color inks. This time difference allows a sufficient drying time for the metallic ink and enables a dye fixative contained in the recording medium to move to the surface layer of the metallic layer. Consequently, a metallic ink layer and a chromatic color ink layer can be formed on the recording medium, thus forming a metallic color image with high glossiness and color saturation.

FIG. 12B is a schematic view of recording operation to record a metallic color image. Recording a red metallic color image is described below by way of example. The recording head 5 is moved once, and then the recording medium is conveyed in the Y direction by a conveyance rate corresponding to four nozzles. This operation is performed multiple times to record a metallic color image on the recording medium.

Although three chromatic color inks of cyan, magenta, and yellow are used in the present embodiment, the time difference required between the metallic ink and each chromatic color ink is often different. Thus, it is desirable that the time difference be adjusted for a color ink that requires the longest time difference. For example, a dye magenta ink is less likely to aggregate and is therefore less likely to remain on the metallic ink layer. In this case, a metallic color image with desired color development can be formed of any combination of a chromatic color ink and a metallic ink by determining the number of use nozzles such that the time difference is adjusted for the magenta ink.

The number of use nozzles and the conveyance rate are not limited to those in the above embodiments. For example, when the time difference can be decreased due to a quick-drying metallic ink, the number of use nozzles can be increased. For example, the metallic ink use nozzles are six nozzles on the upstream side, the chromatic color ink use nozzles are six nozzles on the downstream side, and the conveyance rate of the recording medium is a length corresponding to six nozzles. This can improve productivity. When a long drying time is required for the metallic ink, the metallic ink use nozzles are three upstream nozzles, and the chromatic color ink use nozzles are three downstream nozzles. In this case, the application time difference can be sufficient when the conveyance rate of the recording medium is a length corresponding to three nozzles.

Alternatively, the metallic ink use nozzles are three upstream nozzles, the chromatic color ink use nozzles are six downstream nozzles, and the conveyance rate of the recording medium is a length corresponding to three nozzles. Such a structure can increase the scan number required for the application of chromatic color inks and increase the amounts of chromatic color inks to be applied.

Although an area where the yellow ink use nozzles are included in does not overlap an area where the magenta ink use nozzles are included in, in the Y direction in the present embodiment, the ink color nozzles may be arranged otherwise. The area where yellow ink use nozzles are included in may partly overlap the area where the magenta ink use nozzles are included in, provided that the area where the magenta ink use nozzles are included in is located downstream of the area where the yellow ink use nozzles are included in. A print scan for applying the yellow ink before a print scan for applying the magenta ink can increase the probability of the magenta ink remaining on the surface layer. In this case, a chromatic color ink requires two or more print scans, and multipass recording is performed to apply the ink by two or more print scans. Thus, for example, the application order may be the application scan for the yellow ink alone, the application scan for the yellow ink and the magenta ink, and the application scan for the magenta ink alone.

The scan width of the recording head 5 may be the maximum width of the recording medium in the X direction or may be decreased to the image data width. When one recording medium includes a plurality of images, and the image width is different in each region, the application time difference between the metallic ink and the chromatic color inks is decreased depending on the region. In this case, a metallic color image with high glossiness and color saturation cannot be formed. To avoid this, the application time difference can be adjusted by stopping the head between scans or by decreasing the scanning speed.

Figure 13A:
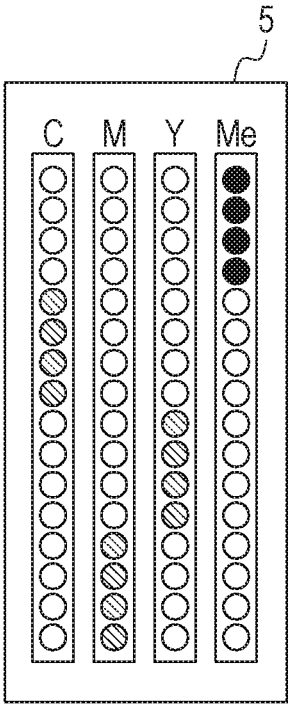
FIGS. 13A and 13B are schematic views of the positions of use nozzles in a recording head.
Figure 13B:
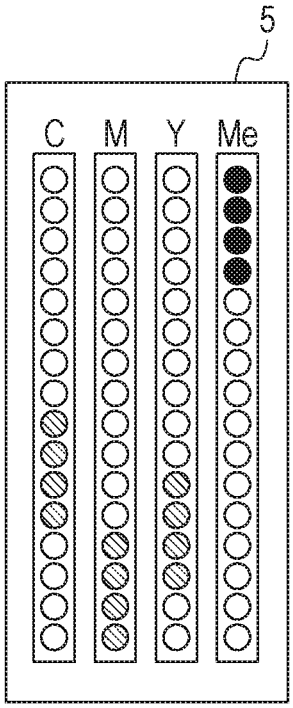

The control of the application order depending on the position of each chromatic color ink use nozzle is not limited to those in the above embodiments. In FIG. 13A, the use nozzles are arranged such that the inks are applied in descending order of aggregability, that is, in the order of the cyan ink, the yellow ink, and the magenta ink. The areas where ink use nozzles are included in do not overlap in the Y direction. FIG. 13B illustrates the areas, where the ink use nozzles are included in, overlapping in the Y direction.

Figure 14:
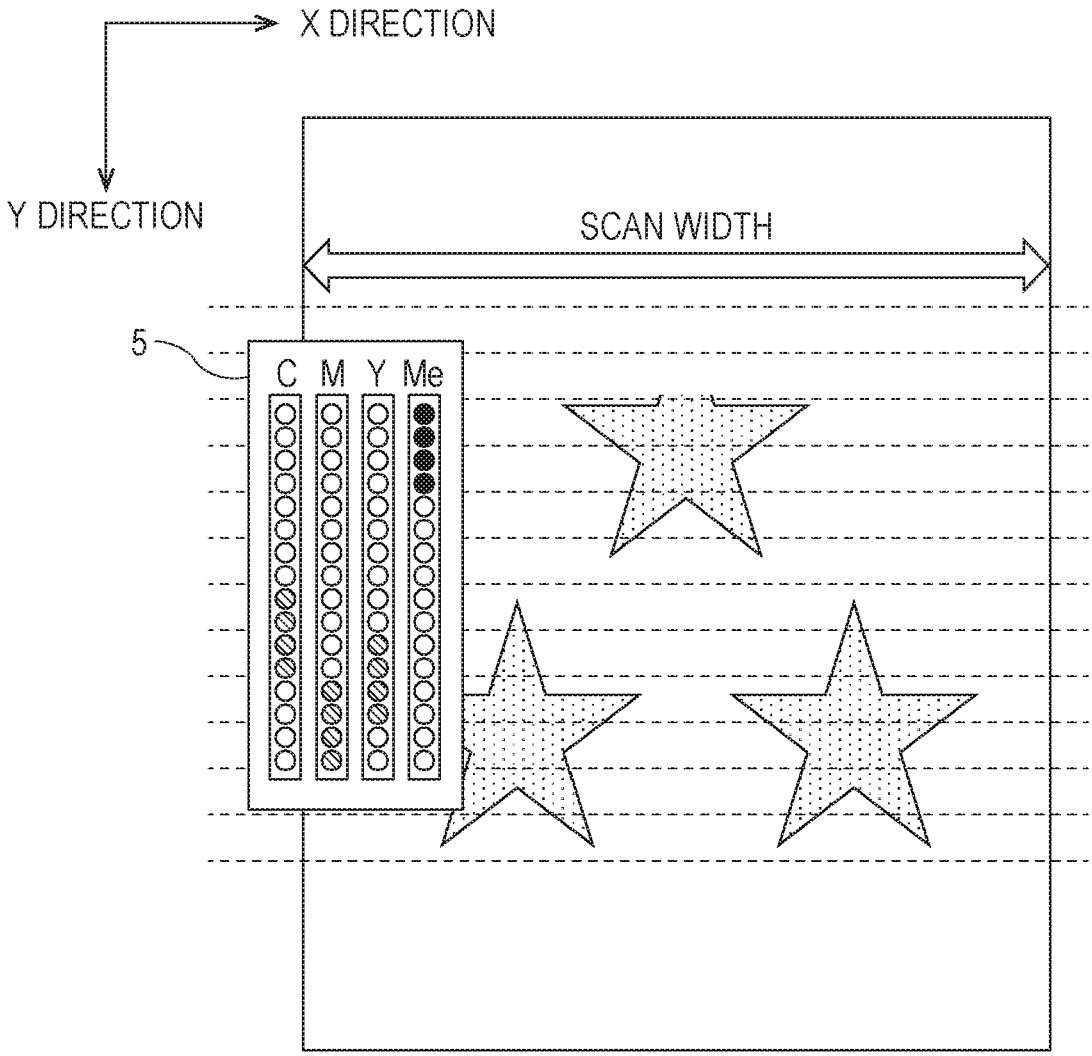
FIG. 14 is a schematic view of recording operation.

FIG. 14 is a schematic view of recording operation to record a metallic color image with the use nozzles arranged as illustrated in FIG. 13B. FIGS. 15A to 15D are schematic views of pass masks used for inks in each scan. In the present embodiment, one conveying operation conveys the recording medium by a length corresponding to two nozzles. Thus, a sufficient time difference corresponding to three scans with the recording head 5 is made between the application of the metallic ink and the application of the chromatic color inks with the use nozzles arranged as illustrated in FIG. 13B. Furthermore, the application time difference between the cyan ink, the yellow ink, and the magenta ink corresponds to one scan with the recording head 5, and only the magenta ink with relatively low aggregability is applied in the final print scan. Thus, an image is formed by two print scans with the metallic ink and each chromatic color ink, that is, by two-pass recording. Multiple print scans with the chromatic color inks can produce a multipass effect of reducing the decrease in image quality resulting from conveyance rate errors and the ejection characteristics of each nozzle.

FIGS. 15A to 15D illustrate the pass masks used for the metallic ink, the cyan ink, the yellow ink, and the magenta ink, respectively. The black pixels are recording permitted pixels, which permit ink application, and the white pixels are recording non-permitted pixels, which do not permit ink application. In each scan (pass), the ink application percentage is 50% in the first pass and 50% in the second pass. The ejection nozzles in the first pass and the ejection nozzles in the second pass do not overlap and have a complementary relationship.

This structure can reduce the decrease in the development of a tint of an ink with relatively low aggregability in the recording of a metallic color image and can form a metallic color image with a tint desired by the user.

Second Embodiment

A second embodiment is described below. In the second embodiment, areas where the chromatic color ink use nozzles are included in, for each of all the colors, overlap in the Y direction. An image is formed by three print scans with each chromatic color ink, that is, three-pass recording. The application percentage in each print scan is different in each ink. The recording apparatus and inks are the same as in the first embodiment.

Figure 15A:
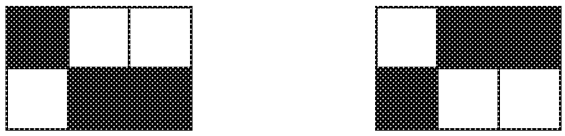
FIGS. 15A to 15D are schematic views of pass masks.
Figure 15B:
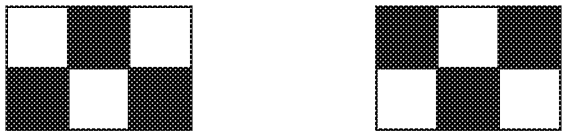
Figure 15C:
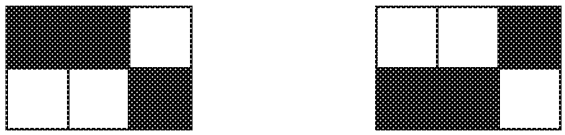
Figure 15D:
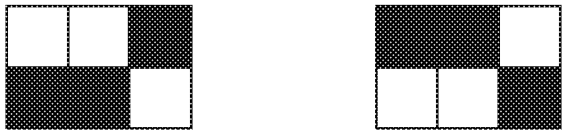
Figure 16:
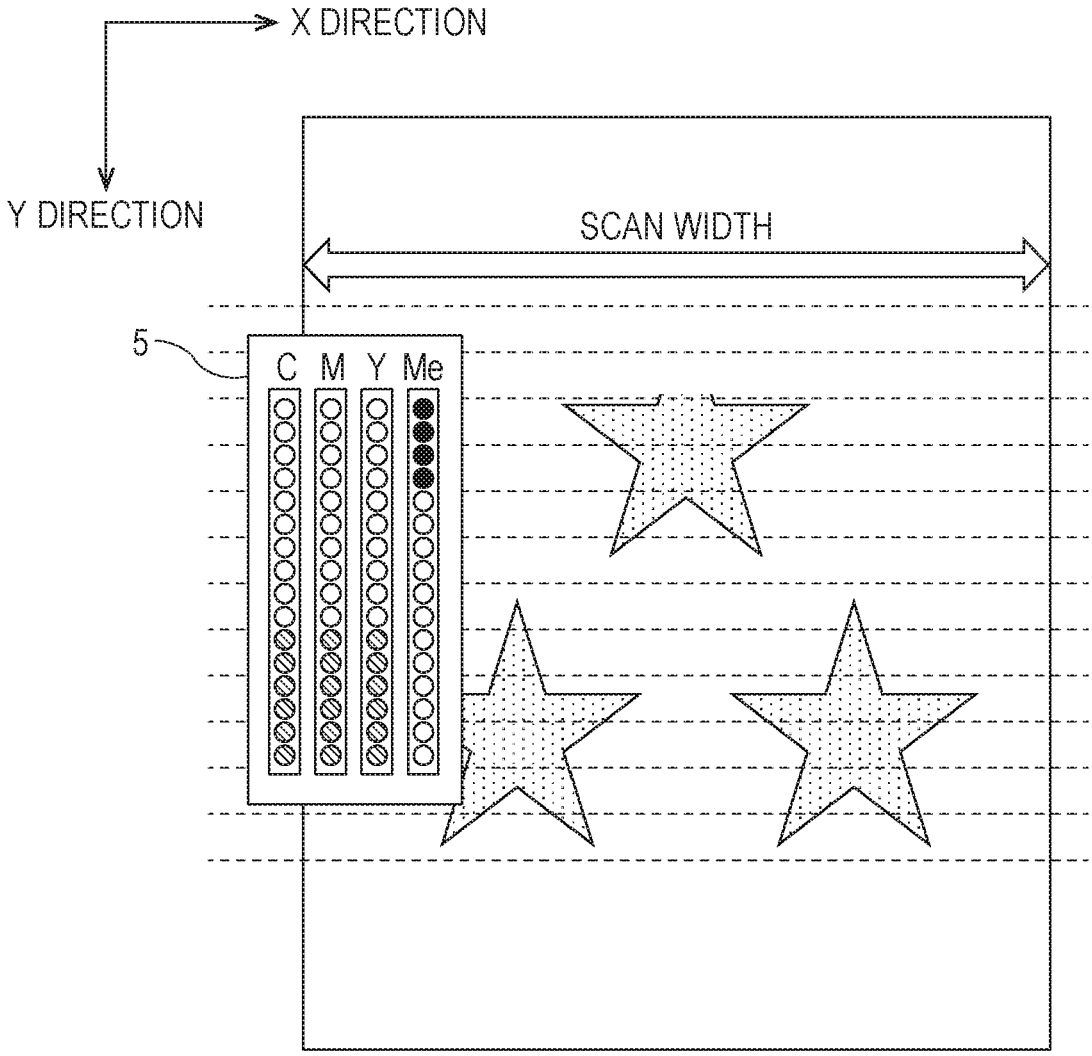
FIG. 16 is a schematic view of a use nozzle region in a recording head and recording operation.

FIG. 16 is a schematic view of the use nozzle region in the recording head 5 and the recording operation of a metallic color image in the present embodiment. The metallic ink has four nozzles on the upstream side, and each of the chromatic color inks cyan, yellow, and magenta has six nozzles on the downstream side. One conveying operation conveys the recording medium by a length corresponding to two nozzles. Thus, an image is formed by multipass recording of two scans with the metallic ink and three scans with the chromatic color inks. The pass mask for the metallic ink is illustrated in FIG. 15A.

Figure 17A:
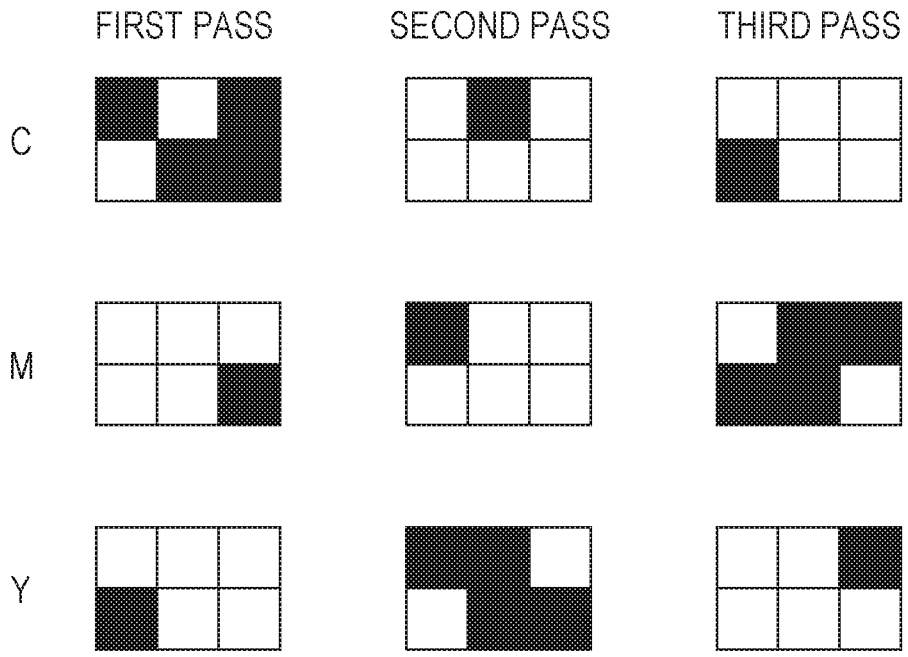
FIGS. 17A and 17B are schematic views of pass masks.
Figure 17B:
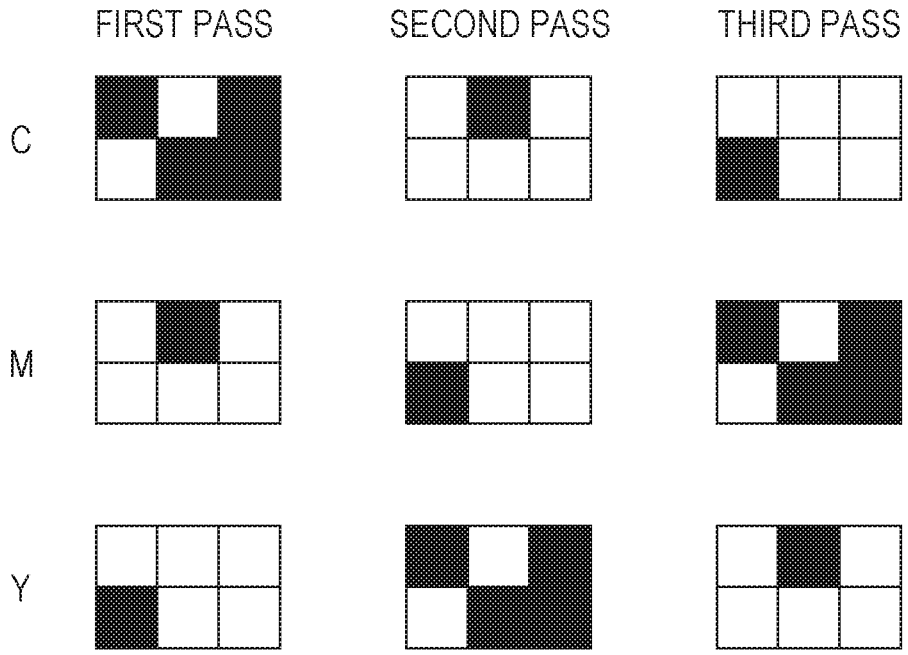

FIGS. 17A and 17B are schematic views of pass masks used for the chromatic color inks in the present embodiment. As described above, the ink application percentage in each scan is different in each ink color. In FIGS. 17A and 17B, the application percentage of the cyan ink is 66.6% in the first pass, 16.7% in the second pass, and 16.7% in the third pass. Likewise, the application percentage of the yellow ink is 16.7% in the first pass, 66.6% in the second pass, and 16.7% in the third pass. Likewise, the application percentage of the magenta ink is 16.7% in the first pass, 16.7% in the second pass, and 66.6% in the third pass. For each mask, the nozzles from which the ink is ejected in each scan do not overlap and have a complementary relationship. In the pass masks illustrated in FIG. 17A, the recording permitted pixels, which permit ink application (recording), and the recording non-permitted pixels, which do not permit ink application (recording), are differently arranged in each ink color. The use of the pass masks differently arranged in each ink color can reduce the decrease in image quality due to robustness to misalignment. In FIG. 17B, the recording permitted pixels and the recording non-permitted pixels have the same arrangement, and different ink colors have different passes with a high application percentage. The use of a combination of masks with the same arrangement in different passes is effective in avoiding the overlap of a plurality of color inks on the same pixel in the same pass.

As illustrated in FIG. 16, the blank nozzle region corresponding to six nozzles is located between the metallic ink and the chromatic color inks. Because one conveying operation between scans conveys the recording medium by a length corresponding to two nozzles, an application time difference corresponding to three scans is made between the metallic ink and the chromatic color inks. During this application time difference, the metallic ink layer is formed, and the dye fixative on the recording medium moves to the surface layer of the metallic layer. For each chromatic color ink, the ink is applied in three scans, and a larger amount of the ink is applied in a different scan. In the present embodiment, the application percentage is determined such that a larger amount of the cyan ink is applied in the first pass, a larger amount of the yellow ink is applied in the second pass, and a larger amount of the magenta ink is applied in the third pass. The application of the larger amount of the magenta ink with relatively low aggregability in the third pass, that is, in the final scan, can reduce the decrease in the color development of the metallic color image due to the magenta ink.

Although the yellow ink and the magenta ink may be applied in the same scan as in the present embodiment, the yellow ink can be mostly applied before the application of the magenta ink. For example, the application of at least half of the total amount of the yellow ink before the application of most of the magenta ink (in the second pass in the present embodiment) enhances the effect of filling with the yellow ink. At least half of the yellow ink may be applied in multiple scans. The application of at least half of the total amount of the magenta ink after the application of most of the yellow ink (in the third pass in the present embodiment) enhances the effect of reducing the decrease in the color development of the magenta ink. At least half of the magenta ink may be applied in multiple scans.

Third Embodiment

Figure 18:
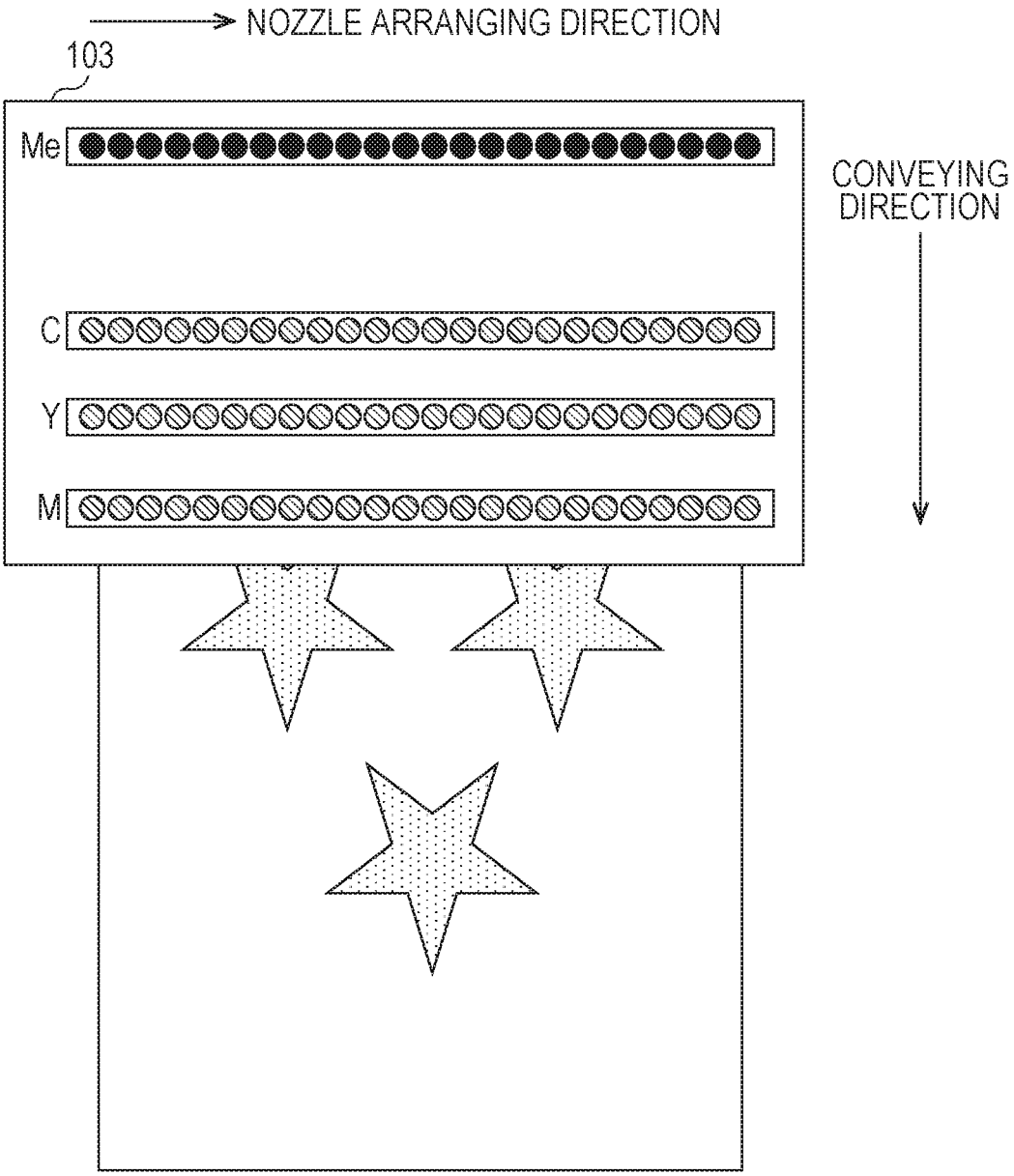
FIG. 18 is a schematic view of a full-multi-type recording head.

A third embodiment is described below. FIG. 18 is a schematic view of the recording operation with a recording head according to the present embodiment. A recording head 103 includes nozzles for applying the metallic ink, nozzles for applying the cyan ink, nozzles for applying the yellow ink, and nozzles for applying the magenta ink arranged in the nozzle arranging direction. An image is recorded on a recording medium conveyed in the conveying direction across the nozzle arranging direction. This is a so-called full-multi-type recording method. The distance between the metallic ink nozzle array and the cyan ink nozzle array is longer than the distance between the chromatic color ink nozzle arrays. The distance between the metallic ink nozzle array and the cyan ink nozzle array makes an application time difference between the metallic ink and the chromatic color inks. The chromatic color inks are applied in descending order of aggregability, that is, in the order of the cyan ink, the yellow ink, and the magenta ink. Thus, the final application of the magenta ink can reduce the decrease in color development due to the permeation of the coloring material through the recording medium.

Other Embodiments

The areas, where the chromatic color ink use nozzles are included in, may overlap in the Y direction, and the percentage in each pass may be different. Although the chromatic color inks are of three colors cyan (C), magenta (M), and yellow (Y), other colors black (K), gray (Gy), light cyan (Lc), and light magenta (Lm) may also be used. Red (R), green (G), and blue (B) inks may also be used as spot colors. Also in these cases, an ink with low reactivity with a dye fixative may be applied after an ink with high reactivity with the dye fixative to reduce the decrease in color development.

Although the metallic ink is used in the above embodiments, another ink that is applied as a background color and requires a sufficient drying time to form its layer may also be used. For example, when a chromatic color ink is applied to a colored recording medium or a permeable recording medium, a white (W) ink may be applied as a background color before the chromatic color ink by one of the methods described in the embodiments.

Although the ink application percentage is controlled by processing color image data into binary data and by thinning with a pass mask before ink application, the application percentage may also be controlled by another method. An original image may be divided into multi-valued data at a ratio depending on the pass and may be processed into binary data by quantization.

In the above embodiments, as illustrated in FIG. 3, the area where use nozzles are included in is limited in a recording head with nozzle arrays overlapping in the Y direction and arranged in the X direction. The present invention is not limited to these embodiments. For example, the recording head may include nozzle arrays not overlapping in the Y direction. In such a case, a metallic ink nozzle array, a yellow ink nozzle array, and a magenta ink nozzle array may be arranged in this order from the upstream side in the Y direction. The application of the yellow ink before the application of the magenta ink can reduce the decrease in the color development of the magenta ink.

The present disclosure can provide a recorded material with a desired metallic color image using a plurality of chromatic color inks containing a dye with different aggregability.

Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-Ray Disc (BD)™), a flash memory device, a memory card, and the like.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-120443 filed Jun. 27, 2019, which is hereby incorporated by reference herein in its entirety.

What is claimed is:

1. An image-recording apparatus comprising:

a conveyance unit configured to convey in a conveying direction a recording medium including a receiving layer containing a dye fixative that aggregates a dye;

a recording head configured to apply an ink to the recording medium during relative movement in a scanning direction across the conveying direction in a print scan, the recording head including a metallic nozzle array, a first color nozzle array, and a second color nozzle array, the metallic nozzle array including a plurality of nozzles from which a metallic ink containing metal particles is ejected, the first color nozzle array including a plurality of nozzles from which a first chromatic color ink containing a coloring material of the dye is ejected, the second color nozzle array including a plurality of nozzles from which a second chromatic color ink containing a coloring material of the dye is ejected, the second chromatic color ink having lower reactivity with the dye fixative contained in the recording medium than the first chromatic color ink; and a controller configured to control operation of recording an image on the recording medium with the recording head and the conveyance unit based on image data including a metallic color image formed by overlapping the metallic ink, the first chromatic color ink, and the second chromatic color ink, wherein the controller controls the recording operation to perform a first print scan in which only the metallic ink is applied to a region in the recording medium in which the metallic color image is to be formed, after the first print scan, to perform a second print scan in which the first chromatic color ink is applied to the region and in which the metallic ink is not applied to the region, and, after the second print scan, to perform a third print scan in which the second chromatic color ink is applied to the region and in which the metallic ink is not applied to the region.

2. The image-recording apparatus according to claim 1, wherein the first chromatic color ink is not applied in the third print scan.

3. The image-recording apparatus according to claim 1, wherein the second chromatic color ink is not applied in the second print scan.

4. The image-recording apparatus according to claim 1, wherein in a final print scan with the recording head only the second chromatic color ink is applied to the region in the recording medium in which the metallic color image is to be formed.

5. The image-recording apparatus according to claim 1, wherein the controller controls the recording operation to perform a print scan between the first print scan and the second print scan in which no ink is applied to the region in the recording medium in which the metallic color image is to be formed.

6. The image-recording apparatus according to claim 1, wherein the plurality of nozzles of the metallic nozzle array from which the metallic ink is ejected in the first print scan is located upstream in the conveying direction from the plurality of nozzles of the first color nozzle array from which the first chromatic color ink is ejected in the second print scan, a first nozzle of the first color nozzle array is located most downstream in the conveying direction among the plurality of nozzles from which the first chromatic color ink is ejected in the second print scan, a second nozzle of the second color nozzle array is located most downstream in the conveying direction among the plurality of nozzles from which the second chromatic color ink is ejected in the third print scan, and the first nozzle is located upstream of the second nozzle in the conveying direction.

7. The image-recording apparatus according to claim 6, wherein a third nozzle of the second color nozzle array is located most upstream in the conveying direction among the plurality of nozzles from which the second chromatic color ink is ejected in the third print scan, and the first nozzle is located upstream of the third nozzle in the conveying direction.

8. The image-recording apparatus according to claim 1, wherein the metallic nozzle array, the first color nozzle array, and the second color nozzle array are arranged in the scanning direction, the nozzles from which the metallic ink is ejected in the first print scan are part of the plurality of nozzles of the metallic nozzle array, the nozzles from which the first chromatic color ink is ejected in the second print scan are part of the plurality of nozzles of the first color nozzle array, and the nozzles from which the second chromatic color ink is ejected in the third print scan are part of the plurality of nozzles of the second color nozzle array.

9. The image-recording apparatus according to claim 1, wherein at least half of a total amount of the first chromatic color ink to be applied to the region in the recording medium in which the metallic color image is to be formed is applied in the second print scan.

10. The image-recording apparatus according to claim 1, wherein at least half of a total amount of the second chromatic color ink to be applied to the region in the recording medium in which the metallic color image is to be formed is applied in the third print scan.

11. The image-recording apparatus according to claim 1, wherein the controller performs the first print scan multiple times before the second print scan.

12. The image-recording apparatus according to claim 1, wherein the controller performs the second print scan multiple times before the third print scan.

13. The image-recording apparatus according to claim 1, wherein the controller performs the third print scan multiple times.

14. The image-recording apparatus according to claim 1, wherein the controller conveys the recording medium in the conveying direction between two continuous print scans.

15. The image-recording apparatus according to claim 1, wherein the metallic nozzle array, the first color nozzle array, and the second color nozzle array are arranged without overlapping in the conveying direction.

16. The image-recording apparatus according to claim 1, wherein the first chromatic color ink is a yellow ink or a cyan ink, and the second chromatic color ink is a magenta ink.

17. The image-recording apparatus according to claim 1, wherein the metal particles in the metallic ink are silver particles.

18. An image-recording method for a recording apparatus, the recording apparatus comprising:

a conveyance unit configured to convey in a conveying direction a recording medium including a receiving layer containing a dye fixative that aggregates a dye; and a recording head configured to apply an ink to the recording medium during relative movement in a scanning direction across the conveying direction in a print scan, the recording head including a metallic nozzle array, a first color nozzle array, and a second color nozzle array, the metallic nozzle array including a plurality of nozzles from which a metallic ink containing metal particles is ejected, the first color nozzle array including a plurality of nozzles from which a first chromatic color ink containing a coloring material of the dye is ejected, the second color nozzle array including a plurality of nozzles from which a second chromatic color ink containing a coloring material of the dye is ejected, the second chromatic color ink having lower reactivity with the dye fixative contained in the recording medium than the first chromatic color ink, the method comprising: performing a first print scan in which only the metallic ink is applied to a region in the recording medium in which a metallic color image is to be formed; after the first print scan, performing a second print scan in which the first chromatic color ink is applied to the region and in which the metallic ink is not applied to the region; and, after the second print scan, performing a third print scan in which the second chromatic color ink is applied to the region and in which the metallic ink is not applied to the region, to record an image on the recording medium based on image data including the metallic color image formed by overlapping the metallic ink, the first chromatic color ink, and the second chromatic color ink.

* * * * *